US005595165A

United States Patent [19]

Conte

[11] Patent Number: 5,595,165

[45] Date of Patent: Jan. 21, 1997

[54] SINGLE-SHOT RUBBERBAND GUN AND SNAP-TOY

[76] Inventor: Agostino B. Conte, 2900 Wilkinson Ave., Bronx, N.Y. 10461

[21] Appl. No.: 349,076

[22] Filed: Dec. 2, 1994

[51] Int. Cl.[6] ..... F41B 7/02; F41B 7/08; A63H 5/04

[52] U.S. Cl. ..... 124/18; 446/401; 446/407; 446/473

[58] Field of Search ..... 124/17, 18, 19, 124/31; 446/401, 405, 406, 407, 473

[56] References Cited

U.S. PATENT DOCUMENTS

| | | | |
|---|---|---|---|
| 876,088 | 1/1908 | Pfeil | 446/401 X |
| 1,660,175 | 2/1928 | Peake | 446/401 X |
| 1,779,507 | 10/1930 | White | 124/18 |
| 1,838,243 | 12/1931 | Wismer | 124/18 X |
| 1,839,700 | 1/1932 | Pino | 124/18 |
| 2,255,563 | 9/1941 | Heminger | 124/18 |
| 2,793,635 | 5/1957 | Koeller | 124/2 |
| 2,898,903 | 8/1959 | Hovermale | 124/18 X |
| 4,436,077 | 3/1984 | Smith | 124/18 |
| 4,554,904 | 11/1985 | Endo | 124/18 |
| 4,827,892 | 5/1989 | Vandermeide | 124/19 |
| 4,961,718 | 10/1990 | Wu | 446/406 |

FOREIGN PATENT DOCUMENTS

| | | | |
|---|---|---|---|
| 885052 | 12/1961 | United Kingdom | 446/401 |

*Primary Examiner*—John A. Ricci

[57] ABSTRACT

A simulated firearm for deploying an elastic loop member herein defined by a barrel portion, a stock or handle portion, body or mid section, and a cocking apparatus. The Operator manually works the cocking apparatus which automatically resets a hammer or sear and a trigger located within the body. At the end of stroke of the cocking apparatus, reset of the firearm is indicated by a soft but crisp reverberation of sound similar to a "click!" as the trigger and hammer interlock, and the trigger makes contact with a stop-pin. An elastic loop member is then stretched between the frontal nose of the barrel, and the hammer located at the rear. By manual operation of the trigger, the elastic loop member is automatically deployed. Simultaneous with the deployment of the elastic loop member, a high pitched reverberation of sound similar to a "snap!" is heard as the hammer or sear makes hard and abrupt contact with the stop-pin. In the preferred embodiment, the firearm could find utility as a simulated weapon for adolescents, and enjoyed as an "office-toy" or conversational piece for adults. In an alternate embodiment, all portions of the simulated firearm that enable loading of an elastic member are made inaccessible. The spirit of the invention within the alternate embodiment is however retained in that the parts as indicated (less the elastic member), operation of the parts, and sounds developed by them remain the same. This alternate embodiment provides a simulated weapon to be enjoyed primarily as a "snap-toy" for small children.

13 Claims, 14 Drawing Sheets

SINGLE-SHOT RUBBERBAND GUN AND SNAP-TOY

BACKGROUND-FIELD OF INVENTION

This invention relates to toy guns, and particularly to simulated guns operable to load and deploy elastic loop members. It is more particularly related to such devices which, in addition to propelling an elastic loop member, comprises added mechanical features that mimic with authenticity, the sounds and motions of conventional guns, together with the more popular simulated versions of same.

BACKGROUND-DESCRIPTION OF PRIOR ART

Persons, primarily adults, have long enjoyed shooting conventional firearms such as hand guns and rifles. Among the users, such enjoyment is accompanied by, among other things, development of skills in accuracy and attaining good control over potentially dangerous weapons. More recently however, many persons ranging from adolescents to adults, have enjoyed popular simulations of conventional firearms such as Paint Ball Guns and High Pressure Water Guns. In part, these simulations have retained popularity by being capable of mimicking features common to most conventional firearms. For instance, both the paint ball gun and the high pressure water gun provide; deployment of projectiles with considerable power, good accuracy, similar size, shape, weight and appearance, and similar mechanical operational likenesses including appropriate reverberations of sound. Users of such simulated firearms also have the added advantage over users of conventional arms in that engagement in competitive and challenging war games is possible with minimal risk of harm to oneself.

With due consideration made to today's technically sophisticated and more popular firearm simulations, one type of firearm simulation which has long been known but has not enjoyed comparable popularity, is commonly referred to as the Rubber Band Gun, Rubber Band Rifle or Rubber Band Shooter. Past suggestions of these simulations have typically operated to propel an elastic loop member or plurality of members. As is evident from past suggestions however, rubber band guns have achieved minimal attention as a viable firearm simulation due primarily to crude operating principles, and lack of realism and authenticity when compared to conventional firearms or the more advanced simulations of same.

With reference made to existing rubber band gun suggestions such as the Vandermeide U.S. Pat. No. 4,827,892 of May 9, 1989, the Endo U.S. Pat. No. 4,554,904 of Nov. 26, 1985, the Smith U.S. Pat. No. 4,436,077 of Mar. 13, 1984, and the Koeller U.S. Pat. No. 2,793,635 of Oct. 13, 1957, the following observation is made; Each of the aforementioned suggestions provides a simulated firearm device which provides the means to manually "load" and "fire" an elastic member or plurality of members. However, no suggestion appears to employ additional operational features such as a manual "cocking" apparatus or, with exception made to the Keoller Patent, a method for creating appropriate sound. Such features would provide to an otherwise uninteresting rubber band gun, a sense of unique realism and authenticity. A lack of such features have however, left rubber band guns of the past to remain objects primarily for use as crude and simple toys, never having achieved the popular status of other types of firearm simulations in the class.

Therefore, it is apparent that there is a need to attain a novel simulated firearm that is operable to propel an elastic loop member. The new simulated firearm however should be unique and different from past suggestions such that in additional to propelling an elastic member, it should achieve greater authenticity than the past suggestions had achieved. Such authenticity should lend itself to considerably more appeal among the present users of rubber band guns and in addition, possibly attain the interest and acceptance of users of the more popular and technically advanced firearm simulations. The resulting increase in popularity and utility of this new simulated firearm should elevate the long-know rubber band gun to a respectable and competitive standing among various other types of popular simulations available in the class.

OBJECTS AND ADVANTAGES

Accordingly, contained within this U.S. Patent is suggested an invention for a simulated firearm that is operable to propel an elastic loop member. Objects and advantages of this firearm over past suggestions comprise, in general, features that are mechanically accurate and simulate, with considerable authenticity, the sounds and actions of real conventional firearms and the more popular simulations of same. Such a firearm could find utility as a fun-to-operate "office toy" for adults, or simulated weapon for adolescents.

In brief, the distinguishing mechanical features comprise a "cocking" apparatus which is used to reset the firearm, and automatic reverberations of appropriate sound coincident with both the "reset" and "firing" sequences.

Additionally, if an elastic member were not employed in it's operation, the basic ideas comprising the spirit of this simulated firearm are such that utility would still be favorable as a "snap-toy" to be enjoyed among small children.

Unlike past suggestions, objects and advantages of this simulated firearm will result in increased popularity among existing users in addition to possibly gaining acceptance and utility by users of more advanced simulations, thereby elevating the firearm to a respectable and competitive standing with other types of firearm simulations in the class.

Further objects and advantages of the simulated firearm will become apparent from consideration of the drawings and ensuing description.

DRAWING FIGURES—SIMULATED FIREARM 200—DRAWING SHEETS 1 TO 7

DRAWING FIGURES—SIMULATED FIREARM 400—DRAWING SHEETS 8 TO 14

Figure 10:
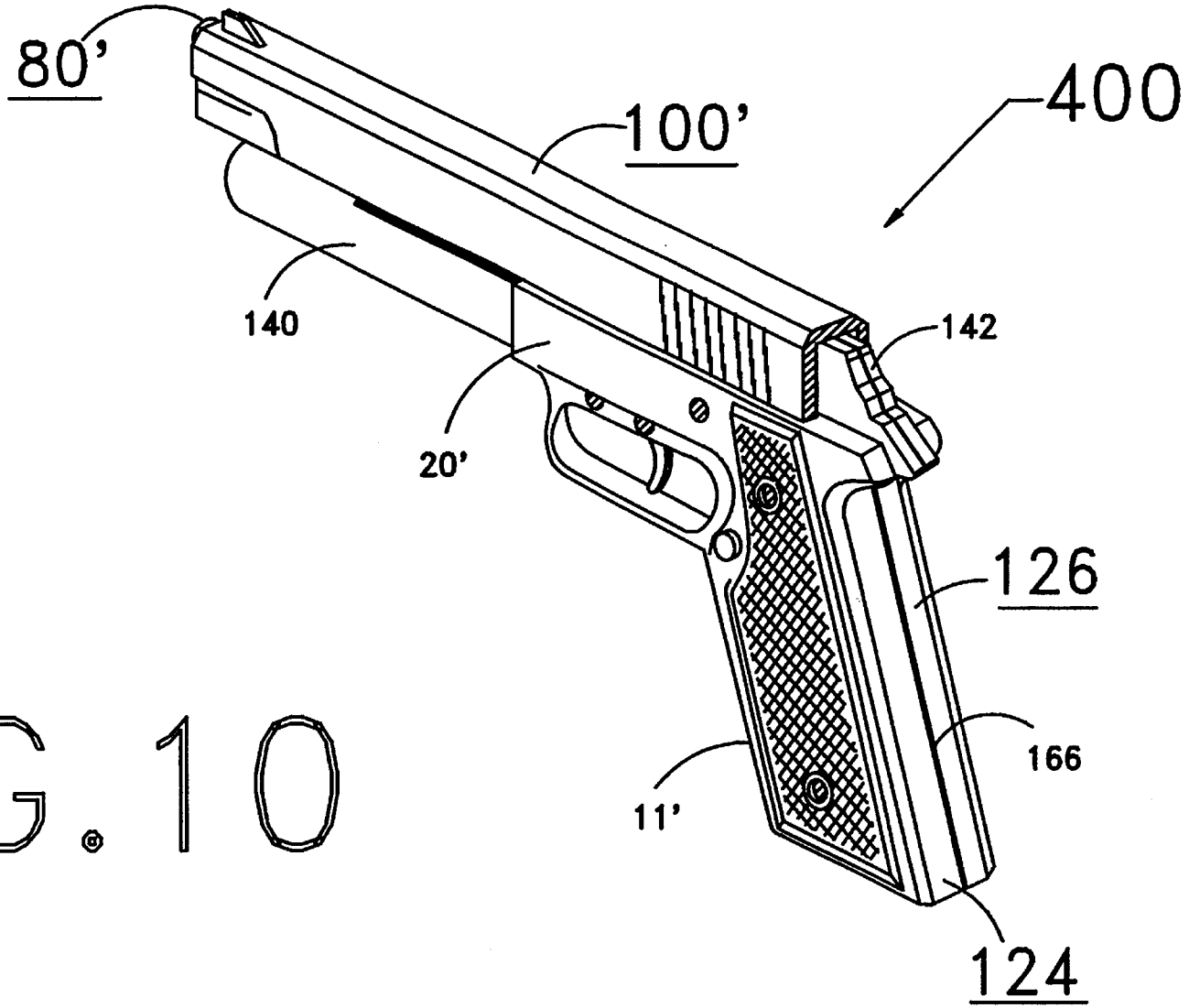

FIG. 10 is a pictorial view of firearm 200 in an alternate embodiment as a "snap-toy" at firearm 400.

Figure 10A:
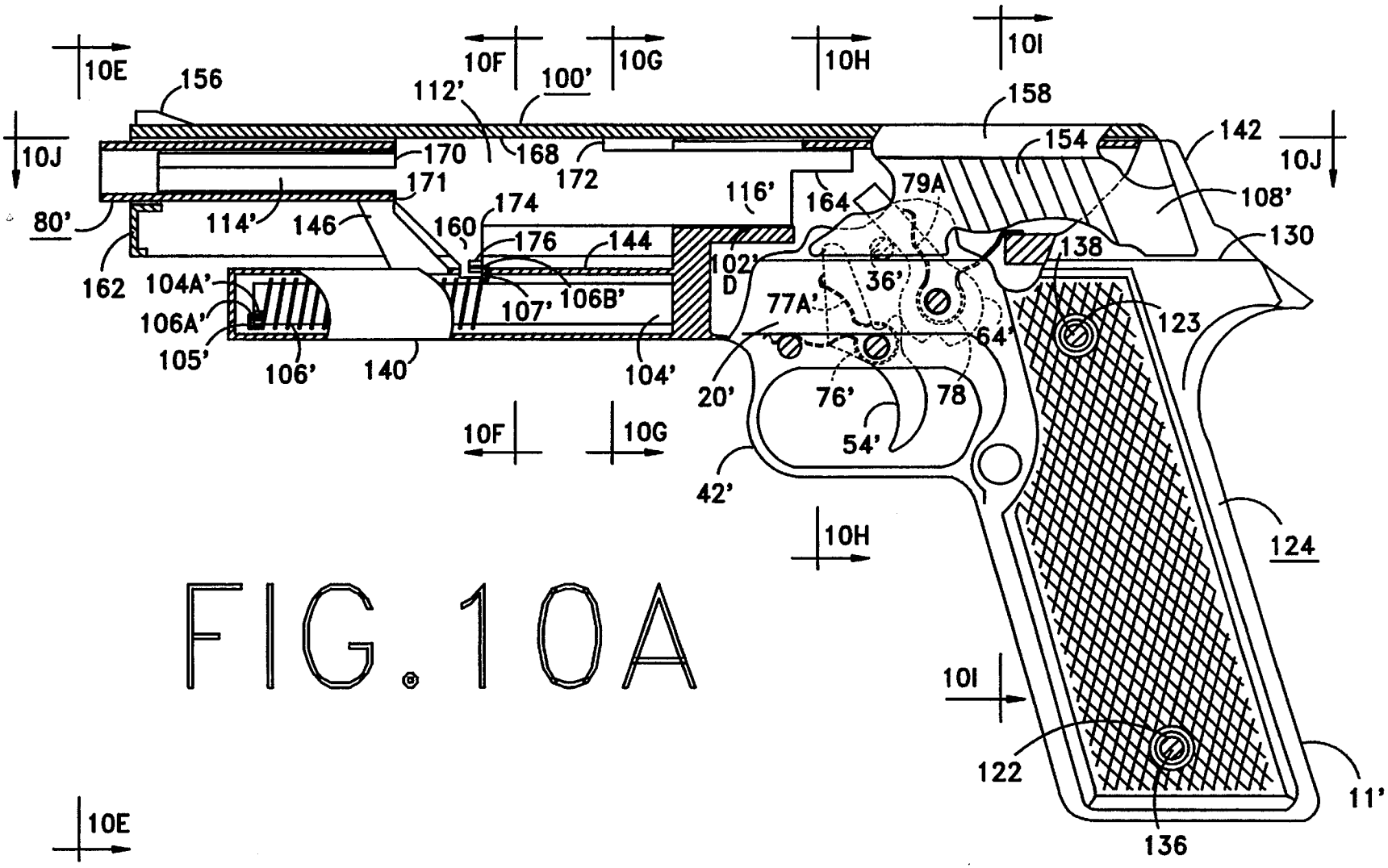

FIG. 10A is a side elevation view of firearm 400 prior to the "reset" and "firing" sequences.

Figure 10B:
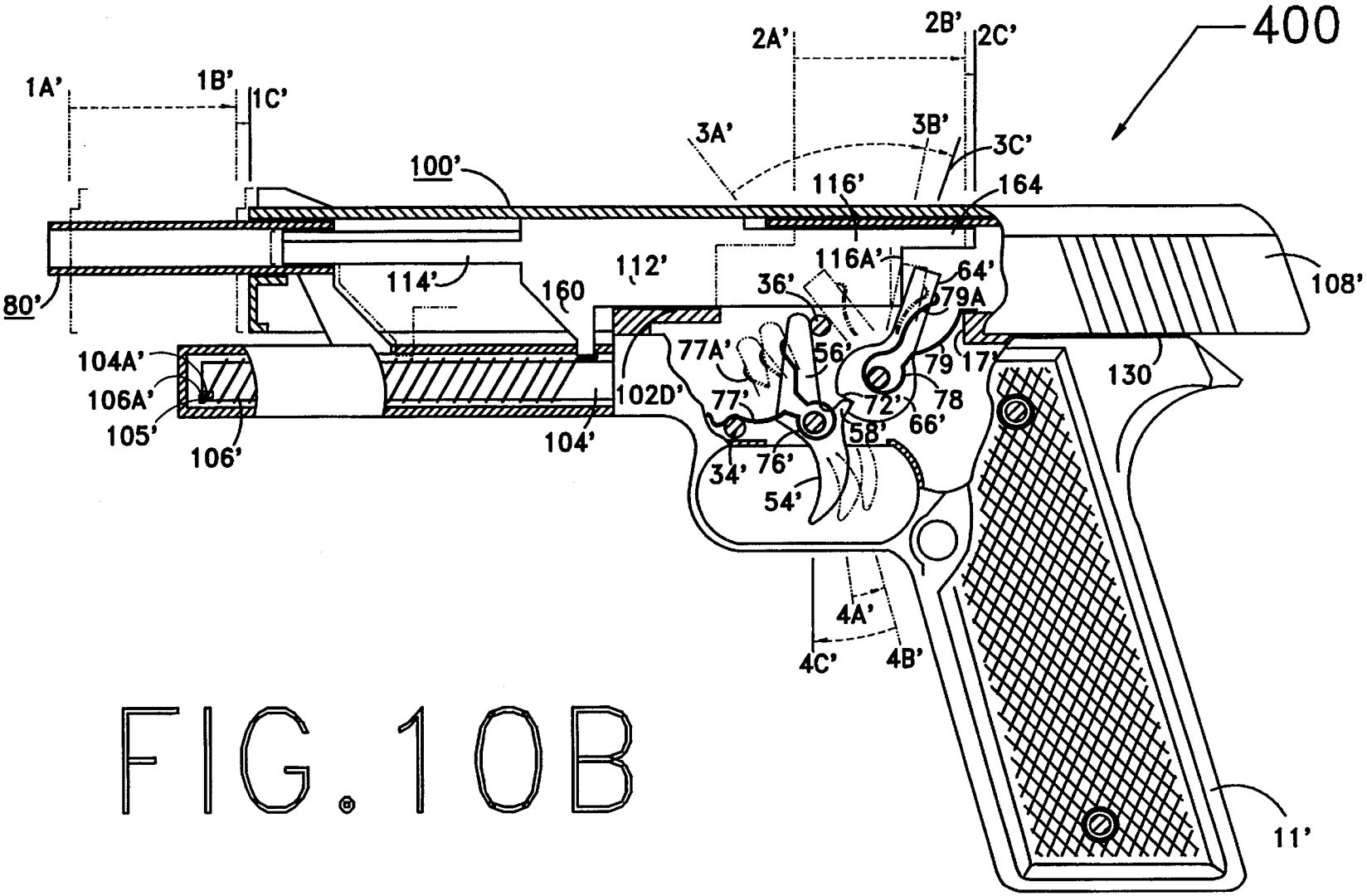

FIG. 10B is a side elevation view of the firearm being operated for "reset".

Figure 10C:
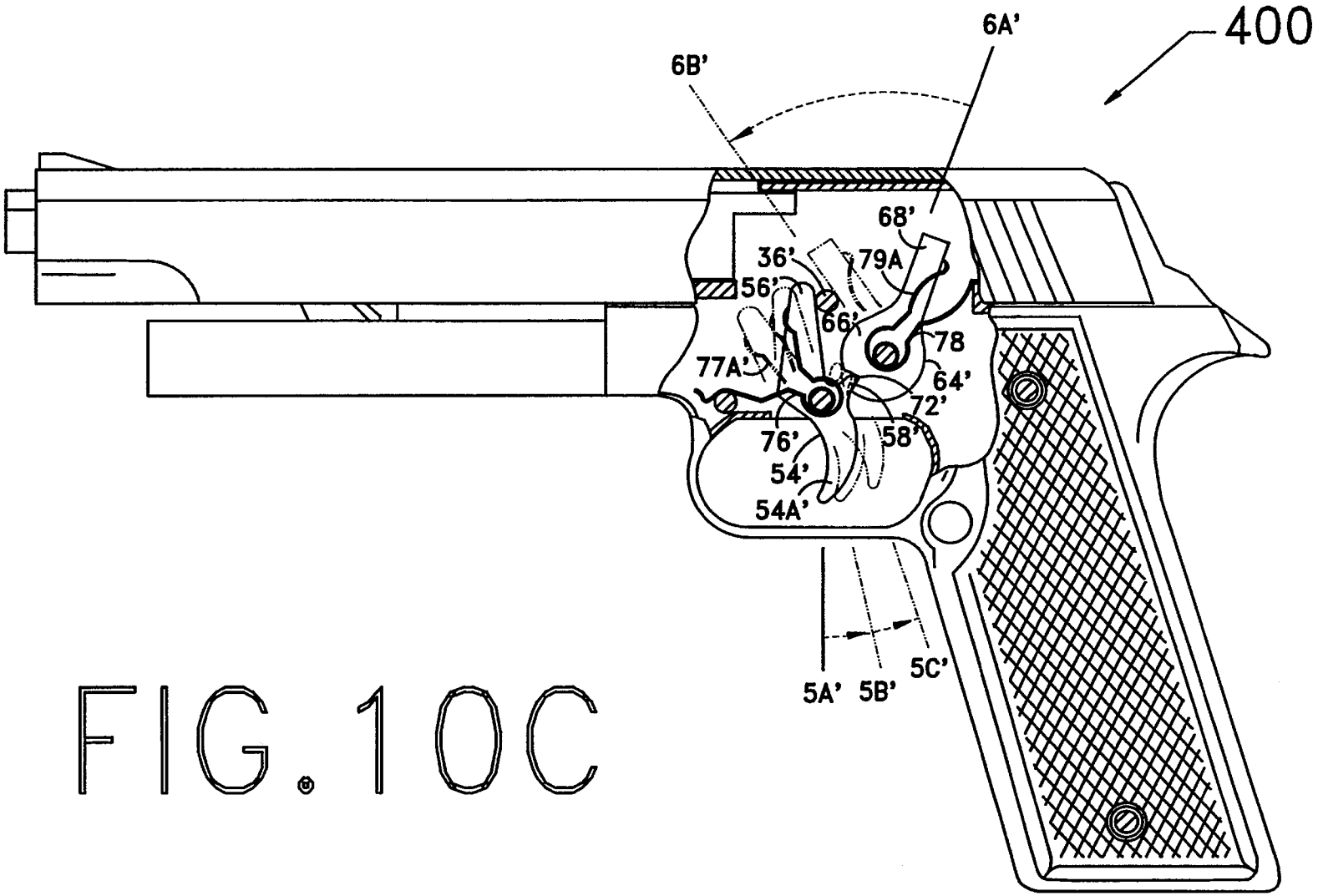

FIG. 10C is a side elevation view of the firearm being operated for "fire".

Figure 10D:
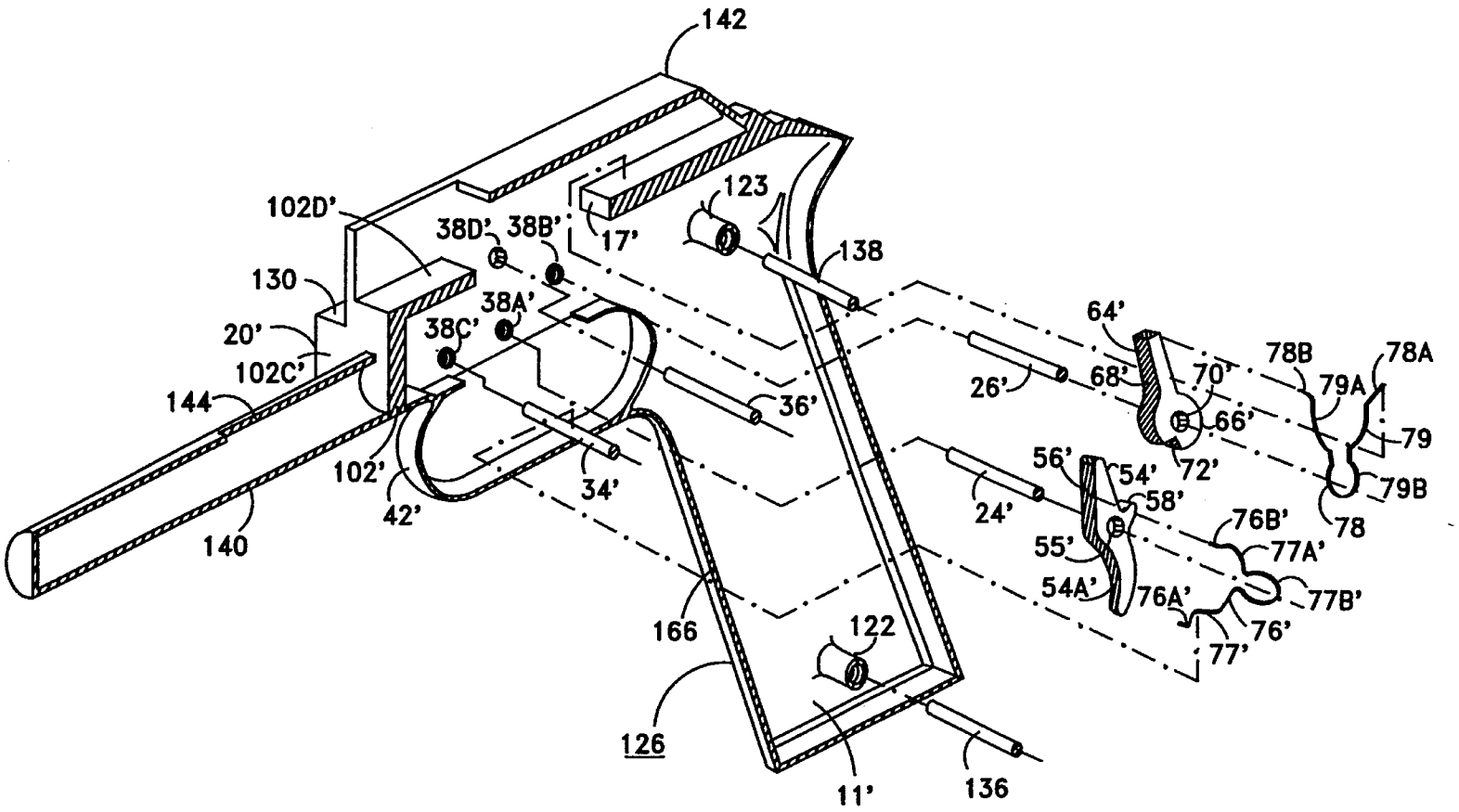

FIG. 10D is an exploded view of side 126 showing internals.

Figure 10H:
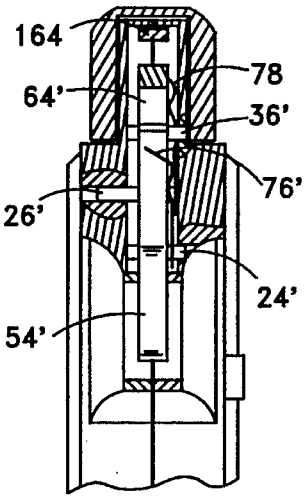
Figure 10G:
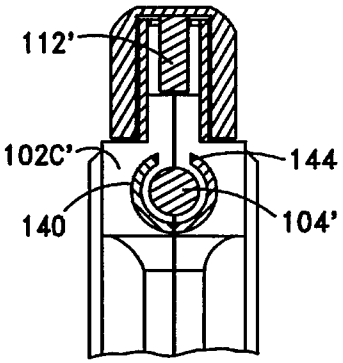
Figure 10F:
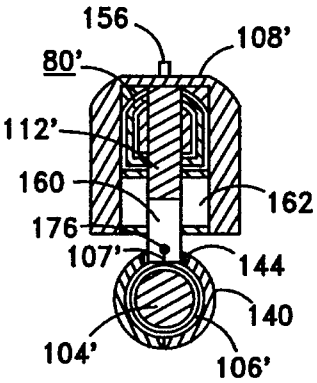
Figure 10E:
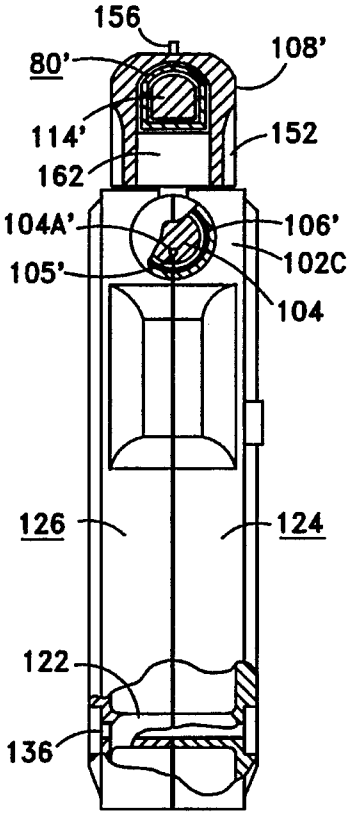

FIG. 10E is a frontal view (refer to FIG. 10A).

FIG. 10F is a sectional view looking from the rear (refer to FIG. 10A).

FIG. 10G is a sectional view looking from the front (refer to FIG. 10A).

FIG. 10H is a sectional view looking from the front (refer to FIG. 10A).

Figure 10I:
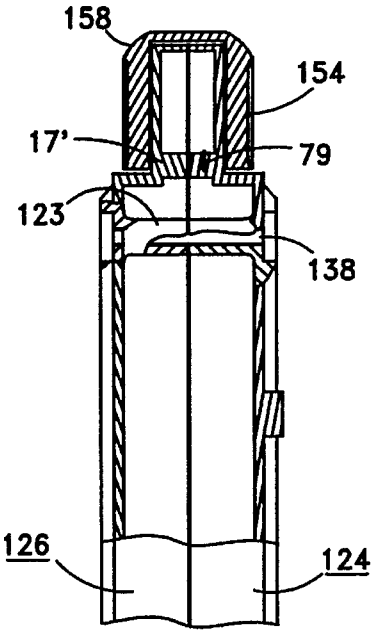

FIG. 10I is a sectional view looking from the front (refer to FIG. 10A).

Figure 10J:
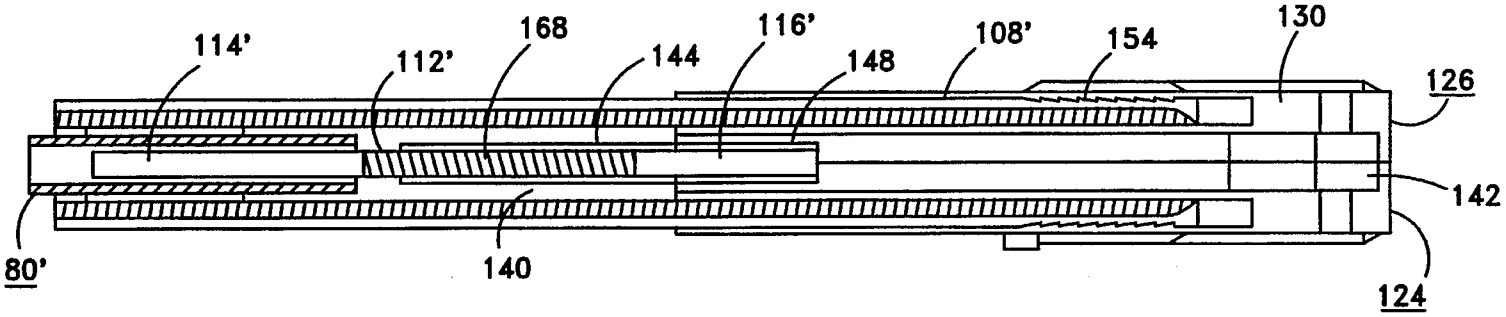

FIG. 10J is a top-sectional view (refer to FIG. 10A).

REFERENCE NUMBERS FOR DRAWING SHEETS 1 TO 7

11—stock, handle or handgrip
11*a*—rased face
12—curve
14—flare
17—vertical face
20—body or mid-section
22—right side panel
22*a*—recessed hole
22*b*—recessed hole
22*c*—recessed hole
22*d*—recessed hole
24—pin member
26—pin member
28—lateral member
30—vertical member
32—left side panel
34—torque spring pin
36—stop pin
38—rased surface
38*a*—hole
38*b*—hole
38*c*—hole
38*d*—hole
40—chamfer
40*a*—slope
40*b*—lateral curvature
42—trigger guard
50—concentric spacer
51—dashed line
52—concentric spacer
53—dashed line
53*a*—angle
54—trigger
54*a*—downward leg
55—hole
56—upward leg
56*a*—line of action
58—short leg
59—turning circle
60—dashed line
61—intersection point
62—intersection point
62*a*—intersection point
63—dashed line
63*a*—angle
64—hammer or sear
65*a*—angle
66—eccentric section or central hub
66*a*—line of action
66*b*—dashed line
66*c*—dashed line
68—upward arm
69—turning circle
70—hole
72—90-degree notch
72*a*—line
72*b*—line
73—point of contact
74—curve or recess
76—torque spring
76*a*—bend
76*b*—bend
77—lower leg
77*a*—upper leg
77*b*—central section
80—barrel
81—left side
82—right side
84—chamfer
86—lower plate member
90—pin member
90*a*—point of contact
91—recessed hole
92—upper plate member
93—recessed hole
94—front nose member
96—base
98—tip
98*a*—sloped notch
98*b*—chamfer
100—cocking apparatus
102—base member
102*a*—right-angled surface
102*b*—right-angled surface
102*c*—front face
102*d*—top face
103*a*—chamfer
104—rod member
104*a*—hole
105—front bend
106—recocking biasing member
106*a*—front leg
106*b*—rear leg
107—rear bend
108—tube member
108*a*—hole
112—cocking ram member
114—front portion
116—rear portion
116*a*—flat-face end with chamfer

REFERENCE NUMBERS FOR DRAWING SHEETS 8 TO 14

11'—stock or handle
17'—vertical or stop face
20'—body or mid-section
24'—pin member
26'—pin member
34'—pin member
36'—pin member
**38*a*'**—hole
**38*b*'**—hole
**38*c*'**—hole
**38*d*'**—hole
42'—trigger guard
54'—trigger
**54*a*'**—downward leg
55'—hole
56'—upward leg
58'—diagonal leg
64'—or sear
66'—central section
68'—upward arm
72'—90-degree notch
70'—hole
76'—torque spring
**76*a*'**—bend
**76*b*'**—bend
77'—lower leg
**77*a*'**—upper leg
**77*b*'**—central section
78—torque spring
**78*a***—bend
**78*b***—bend
79—rear leg
**79*a***—front leg
**79*b***—central section
80'—barrel
100'—cocking apparatus
102'—base member
**102*c*'**—vertical front face
**102*d*'**—top surface
104'—rod member
**104*a*'**—hole
105'—front bend
106'—cocking biasing member
**106*a*'**—front leg
**106*b*'**—rear leg
107'—rear bend
108'—slider-cock
112'—ram member
114'—front or forward portion
116'—rear portion
**116*a*'**—flat-faced end
112—elongated hole
123—elongated hole
124—left side
126—right side
130—lower ledge
136—pin member
138—pin member
140—rod sheath
142—slider guide
144—narrow slot
146—vertical connector
152—concave chamfer
154—sloped vertical lines
156—sight indicator
158—side chamfers
160—lower or tab portion
162—front-end cap
164—rear ram extension
168—attachment point
170—upper vertical lip
171—lower vertical lip
172—corner
174—corner
176—hole

DESCRIPTION—FIGS. 1 TO 9A—DRAWING SHEETS 1 TO 7

Figure 1:
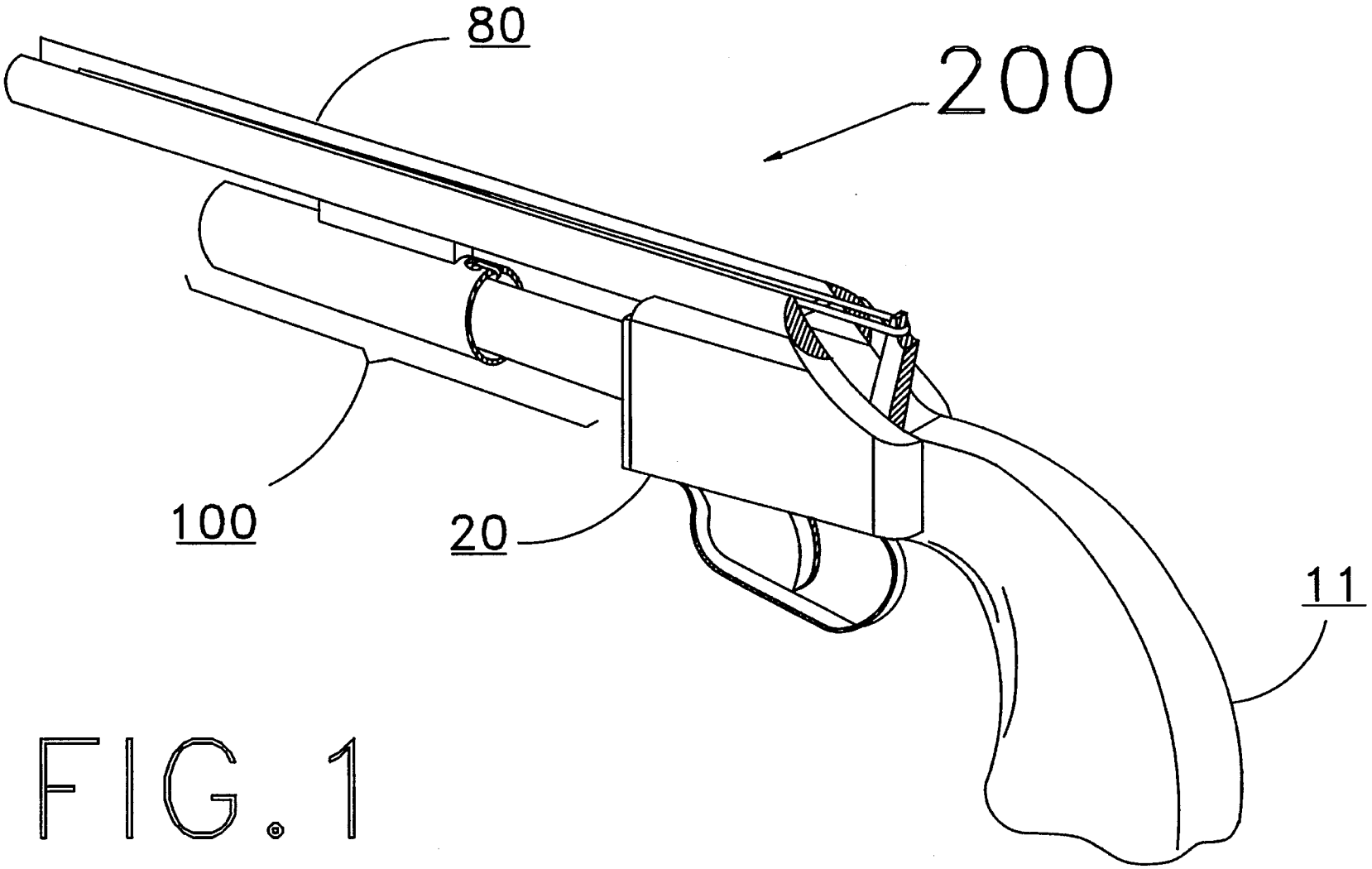
FIG. 1 is a pictorial view of firearm 200 with an elastic loop member "loaded".

Referring to FIG. 1, the firearm is shown pictorially in a preferred embodiment as a simulated old-western pistol or revolver at 200. For descriptive and illustrative purposes, the firearm 200 is assembled in a number of primary parts which themselves are sub-assembled into a number of sub-parts. These primary parts comprise a stock, handle, or hand-grip 11, a body or mid-section 20, an elongated barrel 80, and a cocking apparatus 100. The aforementioned primary parts and sub-parts which make them up may be formed from wood, various types of plastic or other suitable materials as specified, and final assembly of the parts, or variation of same, would be directed by any economical or convenient means known in the art.

Figure 2:
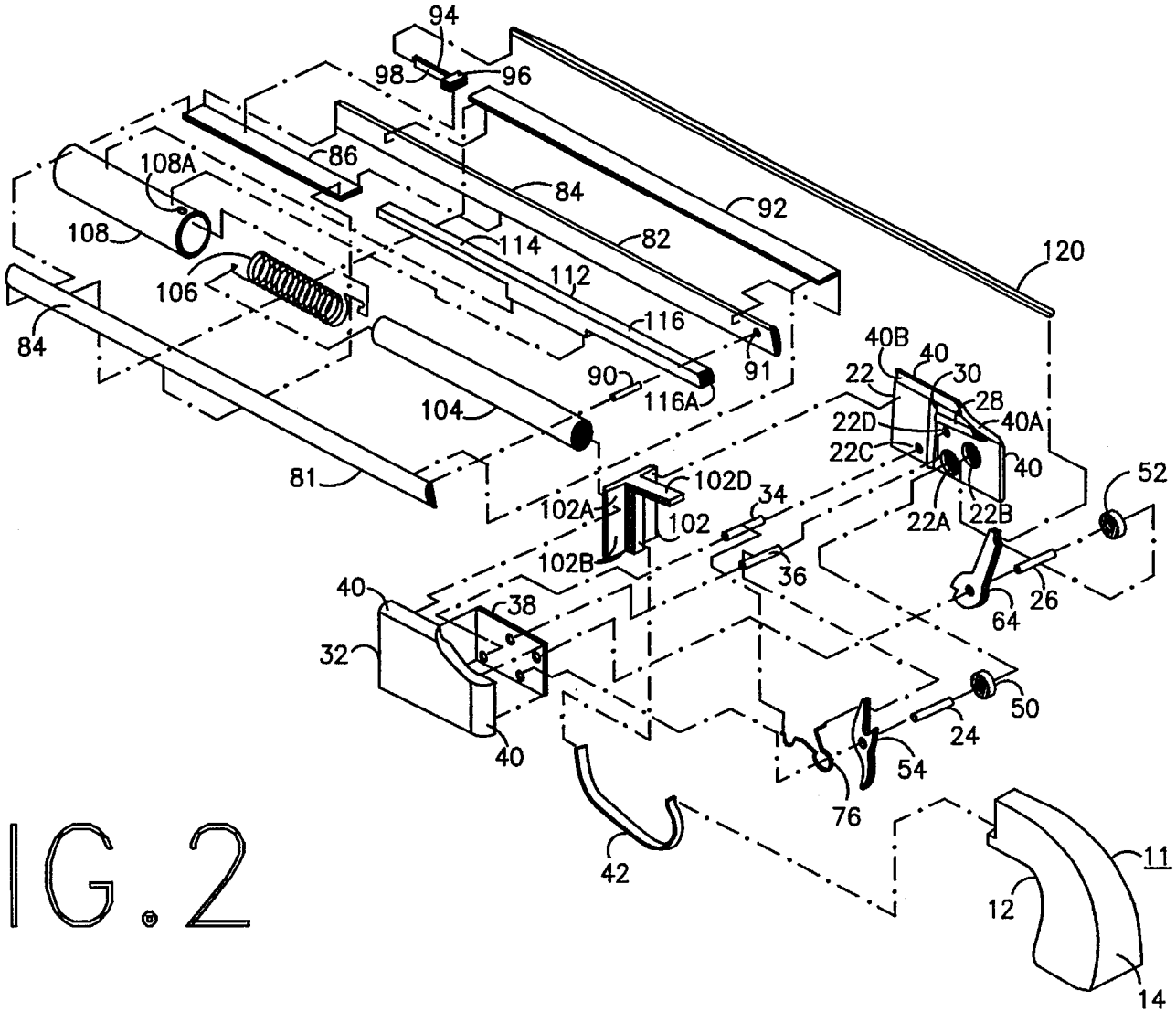
FIG. 2 is an exploded view of FIG. 1.

The ensuing description shall, for the most part, reference the exploded view of FIG. 2. Other figures are also discussed herein as specified.

Stock 11

Figure 5:
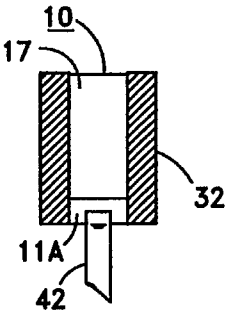
FIG. 5 is a sectional view looking from the front (refer to FIG. 4).

The stock or handle 11 is preferably formed of a solid material having a curve 12 along the front, and a flare 14 along the rear. The curve 12, and flare 14 are dimensioned to appear very similar to like-features found on the handle of most conventional old-western revolvers or pistols. Shown at FIG. 5, a flat vertical face 17 has a rased face **11*a* to which the rear end of a trigger guard 42** is affixed.

Body 20

Pictorially, the body 20 is shown best at FIG. 1. Referring to FIG. 2, body 20 has a side panel 22 and a side panel 32 preferably formed of solid material. Each side 22,32 shows a decorative chamfer 40 along the top the rear edges, and a suitable sloped curvature **40*a* towards the rear and top. The chamfers at 40, and sloped curvatures 40*a* are dimensioned to provide similarity when compared to like-features found on the body or mid-section of most conventional old-western revolvers or pistols. Viewing FIGS. 2 and 7, the sides 22 and 32 provide a lateral curvature 40*b* on the inside surface, along the top. The radius of curve along lateral curvature 40*b* would be provided to match the outside curvature of the parts 81 and 82** (to be discussed later).

Viewing the FIG. 2, a number of depressions appear on the inner surface of side 22. There is a recessed hole **22*a*, and a recessed hole 22*b*. Both recessed holes 22*a*,22*b* preferably have the same diameter and depth, and will form a snug fit when mated to the respective parts 50,52 (to be discussed later). Moreover, there is a recessed hole at 22*c* and a recessed hole at 22*d*. Similarly, both recessed holes 22*c*,22*d* have the same diameter and depth, and will form a snug fit when mated to respective parts 34,36** (to be discussed later).

As provided in the FIG. 2, there is a lateral member 28, and a vertical member 30 affixed to the inner surface of side 22. Both lateral member 28 and vertical member 30 are preferably made of solid rod-like material with uniform thickness and rounded, smooth surfaces along there lengths, except where fixed to the inside of panel 22 where surfaces would be flat.

Figure 3:
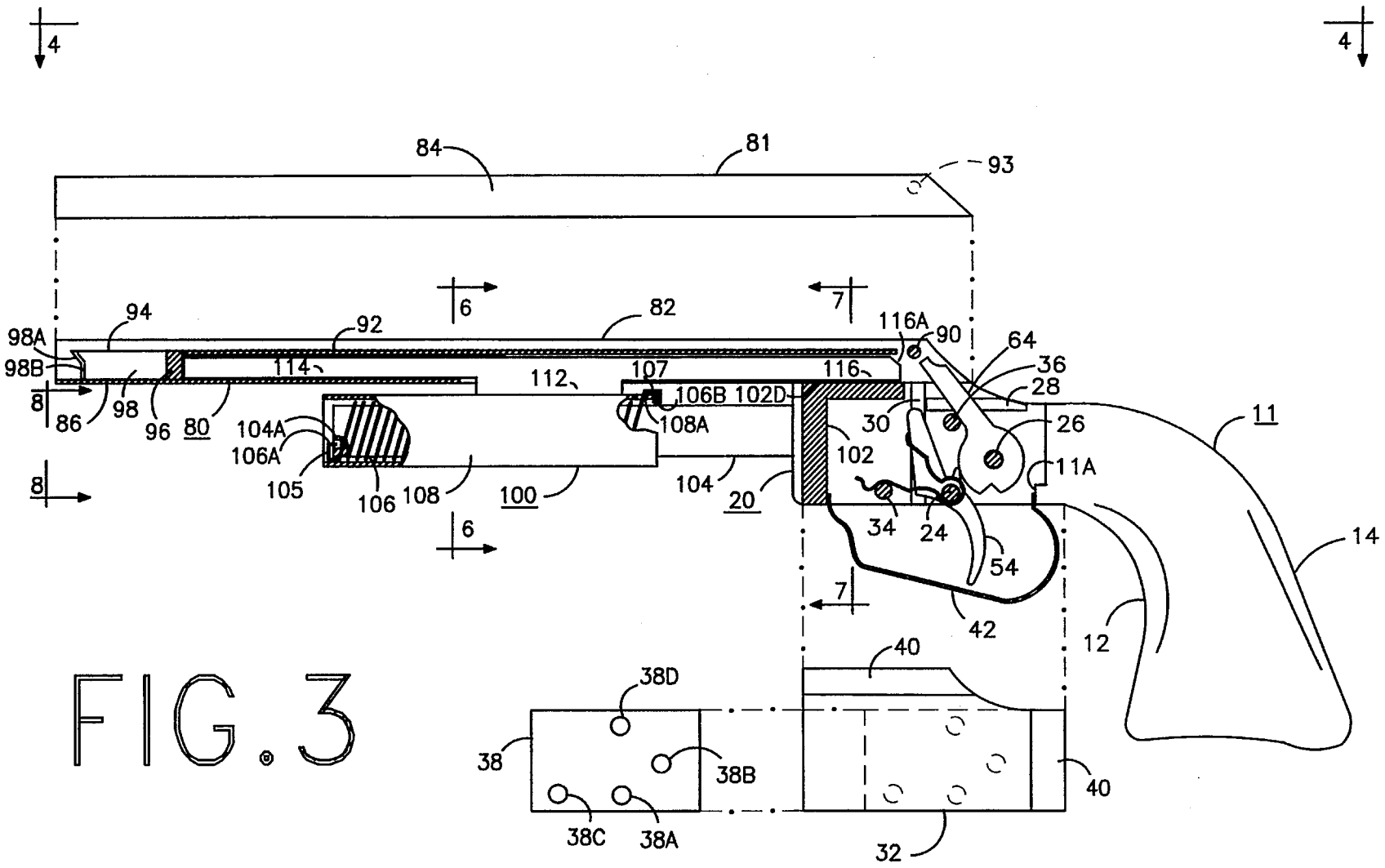
FIG. 3 is a side elevation view of the firearm prior to the "reset" and "firing" sequences.

On the inner surface of side panel 32, there is affixed a rased surface 38. Rased face 38 is preferably formed from solid plate material with uniform thickness and having smooth surface appearance. With reference to FIG. 3, rased surface 38 provides a number of holes. There is a hole 38*a*, a hole 38*b*, a hole 38*c*, and a hole 38*d*. All the holes 38*a* through 38*d* are of the same diameter, and completely penetrate the rased surface 38. The diameter of each of the holes 38*a*, 38*b*, 38*c*, and 38*d* are such as to create a snug fit when mated to respective part nos. 24,26,34,36 (to be discussed next).

A pin member 24 provided in FIG. 2, is preferably formed of solid rod-like material with flat-faced ends, a circular cross section along the length, uniform diameter, and smooth surface appearance. Moreover, pin member 24 is shown affixed on one end to the center of the recessed hole 22*a*. FIG. 3 shows the other end of pin 24 affixed at the hole 38*a*. The length of pin 24 would preferably be no greater than twice the width (thickness) of either side 22 or 32. Similarly provided at FIG. 2, a pin member 26 has the same form, length, and appearance as pin member 24. Pin 26 is affixed at one end to the center of recessed hole 22*b*. Viewing FIG. 3 shows the other end of pin 26 to be affixed in the hole at 38*b*.

A stop pin 36 is now depicted in FIG. 2 with the same length, form and appearance as pin members 24 or 26. The stop pin at 36 is affixed at one end to the side panel 22, at recessed hole 22*d*. Viewing FIG. 3 shows the other end of stop pin 36 affixed to rased surface 38 at hole 38*d*.

Figure 9:
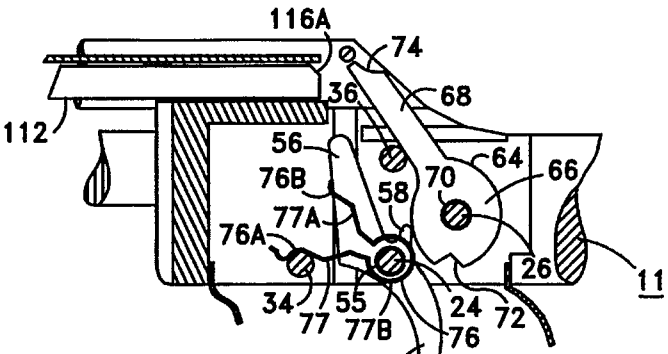
FIG. 9 is a detail showing the internals of body 20.
Figure 9A:
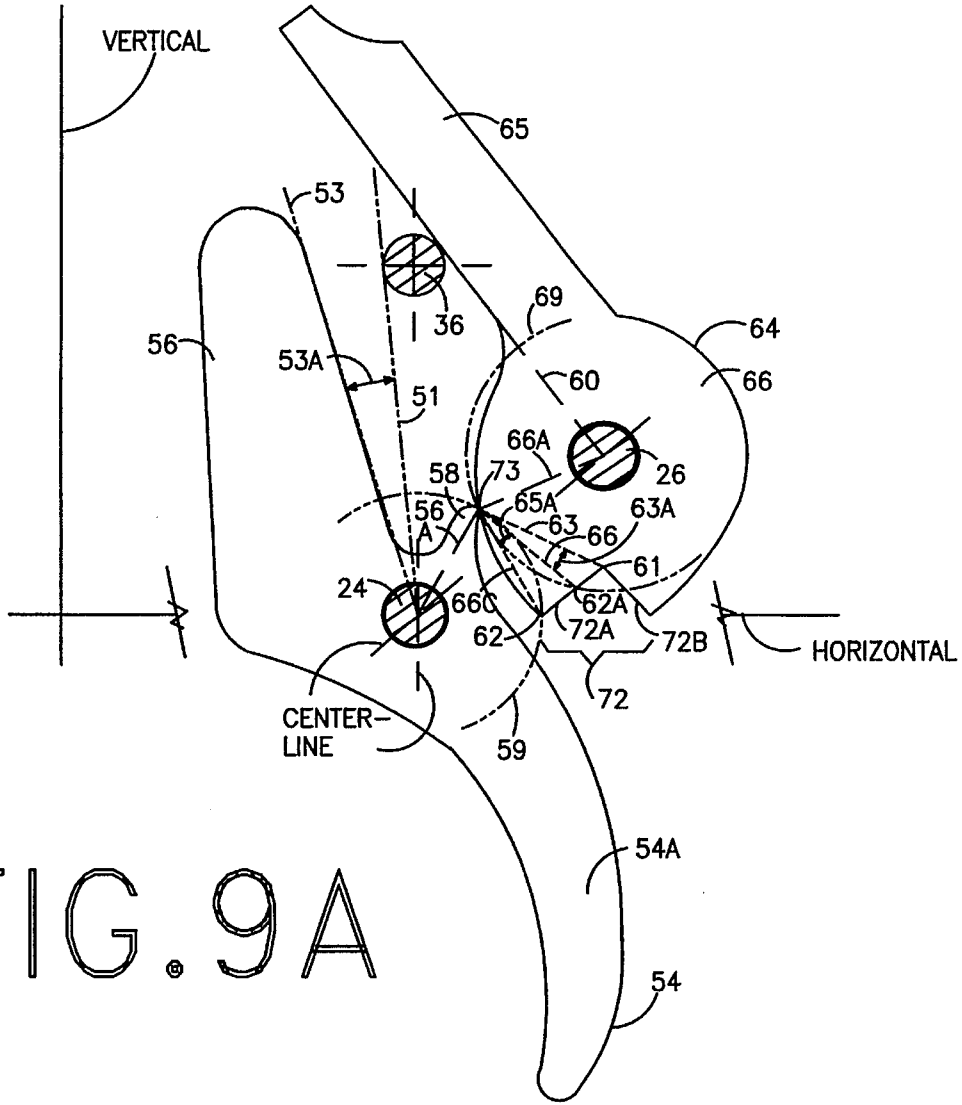
FIG. 9A is a detail showing the relationship between the hammer and trigger members.

As best viewed from the FIG. 9A, the above mentioned pin members 24,26 and stop pin 36 are oriented about the vertical and horizontal axes in a specific manor. The pin 24 and stop pin 36 are positioned along a vertical centerline as shown. The pins 24 and 26 are however, positioned along centerline, preferably 40-degrees from horizontal.

Regarding the FIGS. 2 and 3, a torque spring pin member 34 is now provided. The torque spring pin 34 has equal length, form, and appearance to any of pins 24,26 or 36 as previously discussed. The torque spring pin 34 is shown to be affixed at one end to side panel 22 at recessed hole 22*c*. The other end of pin 34 is affixed to rased surface 38 at hole 38*c*.

Figure 7:
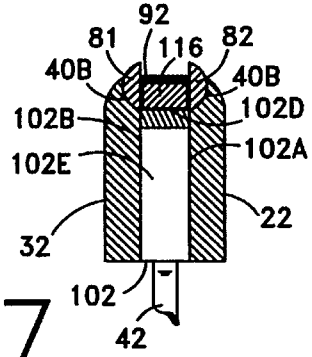
FIG. 7 is a sectional view looking from the rear (refer to FIG. 3).

Viewed in the FIG. 2, a base member 102 is provided. Base member 102 is preferably formed of solid material having a right-angle contact surface 102*a*, a right-angle contact surface 102*b*, and a top surface at 102*d*. All surfaces 102*a*, 102*b*, 102*d* are level and smooth. With reference made to FIG. 7, right-angle contact surface 102*a* is shown to mate to the inner surface of side 22. Similarly, right-angle contact surface 102*b* mates to the inner surface of side 32.

Figure 6:
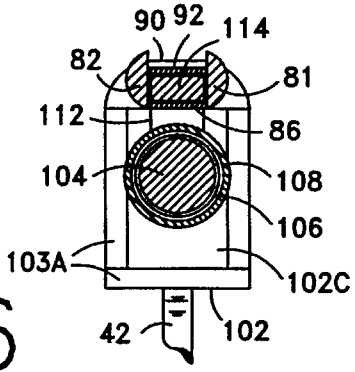
FIG. 6 is a sectional view looking from the front (refer to FIG. 3).

With reference made to FIG. 6 and FIG. 7, base member 102 also has a front surface 102*c*, and a rear surface 102*e*. Front surface 102*c* is plumb and smooth with a decorative chamfer 103*a* along the vertical and bottom edges. The rear surface at 102*e* is plumb, smooth, and affixes at the bottom to the front portion of the trigger guard 42.

Next, are the movable (or floating) members within the body 20 as shown in the FIG. 2.

Comprised among the movable members are a concentric spacer 50 and a concentric spacer 52. Concentric spacer 50 is preferably made solid with uniform thickness, a smooth surface appearance, and will fit snugly into recessed hole 22*a* of side 22. Similarly, concentric spacer 52 is provided with the appearance and dimensions equal to concentric spacer 50, and will fit snugly into recessed hole 22*b* of side panel 22.

Both concentric spacers 50,52 are provided with a magnitude of thickness such that each spacer will exhaust (fill) the total depth of respective holes 22*a*,22*b*, and emerge to form rased circular surfaces on the inner face of side 22. The magnitude of emergence of spacers 50,52 from holes 22*a*, 22*b* is equal to the magnitude of thickness of either lateral member 28, or vertical member 30. The diameter of the central hole at the spacers 50 and 52 is such as to create a snug fit when mated to the respective pins 24 and 26.

Next, a trigger 54 and a hammer or sear 64 are presented in the FIG. 2. Trigger 54 is preferably formed of solid material with uniform thickness. Regarding the detail of body 20 at FIG. 9, trigger 54 has a downwardly extending leg 54*a*, an upwardly extending leg 56, and a upwardly diagonal leg 58. Legs 54*a*,56,58 are shown to be tapered to a slight degree and a hole at 55 is provided at the central point of integration of all legs. The diameter of hole 55 located in the central hub is slightly greater than the diameter of pin member 24.

The hammer or sear 64 is preferably formed solid with uniform thickness equal to trigger 54. Hammer 64 depicts an upwardly extending 68, integrated at the base with an eccentric section or central hub 66. Eccentric section 66 has a 90-degree notch along the contour or periphery at 72, and the arm 68 has a curve or recess at 74 that is located at the rear-tip. Moreover, a hole 70 is shown about the central region of eccentric section 66 with a diameter that is slightly greater than the diameter of respective pin member 26.

The physical dimensions of both the hammer 64 and the trigger 54 are derived from the angular relationships as shown in the FIG. 9A. As depicted by FIG. 9A, diagonal leg 58 of trigger 54 has a line of action 56*a*. The line of action at 56*a* extends from the center of rotation at pin 24, to the tip of diagonal leg 58. Line 56*a* will also scribe a circular path 59 as the trigger is rotated about pin 24. Similarly, the hammer 64 has a line of action at 66*a*. Line 66*a* extends from the center of rotation at pin 26, to a point 73, and is preferably equal in length to line 56*a*. The point at 73 defines the place at which the tip of diagonal leg 58 meets the rim or contour of eccentric section 66. Line 66*a* also defines a circular path 69 that would scribe though a rotation of hammer 64 if the eccentric section 66 were actually symmetrical about the pin 26. The hammer at 64 also shows a dashed line 60 that aligns the inner tangent of [straight leg] arm 68 with the center of rotation at pin member 26.

Regarding trigger 54, the angular location of the leg 56 with respect to center of rotation, and the pin member 36, is defined respectively by a dashed line at 53 and a dashed line at 51. The lines 53,51 form an angle at 53*a* that "off-sets" the inner tangent of [long] leg 56 with respect to the edge of stop pin 36.

Regarding hammer 64, eccentric section 66 shows the notch at 72. Notch 72 is formed of dimensions which are governed by the amount of "eccentricity" assigned to eccentric section 66, and the amount of "off-set" assigned to leg 56 of trigger 54.

A theoretical magnitude of "eccentricity" provided at notch 72 would preferably be defined by an angle 65*a* made between a dashed line 66*c* and a dashed line 66*b*. Line 66*c* extends from the tangent of circle 69 at point 73, to a point of intersection with circle 59 at 62. Similarly, the line 66*b* extends from the tangent of circle 59 at point 73, to a point of intersection with the circle 69 at 62*a*.

A theoretical magnitude of "off-set" provided at the notch 72 would preferably be defined by an angle 63*a* formed between a dashed line 63 and the dashed line 66*b*. Line 63 originates at point 73, and angle 63*a* equals the angle of "off-set", 53*a*.

"Eccentricity" and "off-set" are summed up in order to form the physical magnitude notch 72. A line 72*a* is extended between points 62 and 62*a* to define "eccentricity". The line 72*a* is continued from point 62*a* to a point of intersection with line 63 at 61 to define "off-set". To complete the formation of notch 72, a line 72*b* is formed perpendicular to line 72*a*, and of the same magnitude. Line 72*b* begins from intersection point 61.

Regarding the FIG. 2, a torque spring 76 is now provided. Viewing the FIG. 9, torque spring 76 is preferably shown as a length of spring [wire formed as a torque spring] with suitable gauge diameter, and having a central section at 77*b*, a lower leg member at 77, and an upper leg member at 77*a*. The lower leg 77 has a bend 76*a* at the tip. Similarly, the upper leg 77*a* has a bend 76*b* at the tip. The torque spring at 76 is shown to encircle pin member 24 at circular section 77*b*, and legs 77,77*a* are wedged or trapped via respective bends 76*a*,76*b*, between respective torque spring pin member 34 and leg 56 of trigger 54.

Barrel 80

Pictorially, the barrel 80 is shown best at FIG. 1. Referring to the exploded view of FIG. 2, barrel 80 has a side at 81 and a side at 82. The sides 81,82 are preferably formed of solid elongated material that has been shaped with a decorative chamfer 84 along the outside edges. With reference to FIGS. 2,3, the inner surfaces of the sides 81,82 are even, straight and smooth, and show a respective pair of recessed holes 91 and 93, each with equal depth and located toward the rear. The diameter of holes 91,93 are equal, and such as to create a snug fit with either end of a pin-like member defined by part 90 (discussed below).

Figure 4:
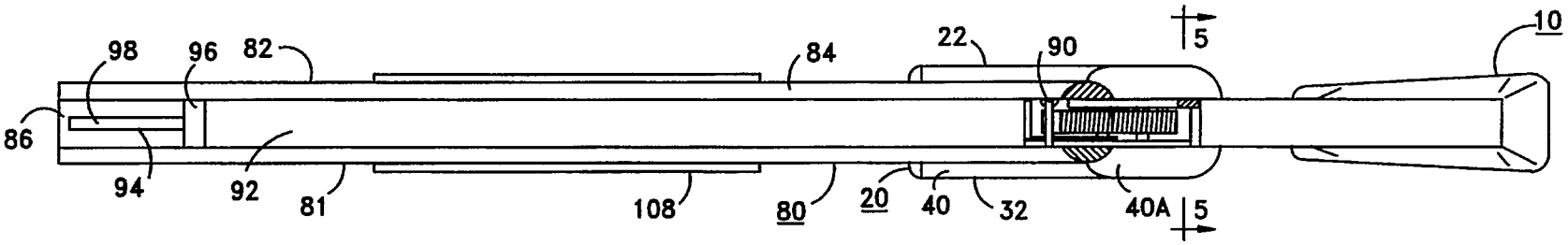
FIG. 4 is a top view (refer to FIG. 3).

Regarding the FIG. 2, affixed between sides 81,82 is a lower plate member 86, an upper plate member 92, a front nose member 94, and a pin member 90. Lower plate 86 is formed of uniformly thin and smooth plate material that affixes to the lower front portion of the barrel 80 between sides 81,82. With reference made to FIG. 4, the width of lower plate 86 is equal to the distance between the inner surfaces of sides 22 and 32. Viewing FIG. 3 shows the length of lower plate 86 to be slightly greater than the combined lengths of nose member 94, plus the member 114 (to be discussed later).

Viewing FIGS. 2,3,4, the upper plate member 92 is preferably formed of the same thin smooth plate material as lower plate 86 and affixes between the sides 81,82. The length of upper plate 92 is such to provide space to install nose member 94, and pin 90 at the respective front and rear of barrel 80.

The front nose member 94 is preferably made of solid material comprising a base 96, and a tip 98. Base 96 is even and smooth on all sides, and has a width equal to the width of either lower plate 86 or upper plate 92 (see FIG. 4). Moreover, base 96 is affixed at the sides to the inner surfaces of sides 81,82. FIG. 3 shows the lower surface of base 96 affixed to the top surface of lower plate member 86. Furthermore, base member 96 affixes at the rear, to the front edge of the upper plate member 92. At the frontal surface, base 96 affixes to the rear edge of tip 98.

Viewing FIGS. 2,3 or 4, the tip member at 98 is oriented to be affixed on edge, to the center-top surface of lower plate member 86, and the center-front surface of base member 96. Located along the front of tip 98 is a sloped notch 98*a* having a chamfer 98*b* along the edges. Moreover, the height of tip 98 when standing on edge as shown, would be no greater than the height of space provided between lower plate 86 and upper plate 92.

With regard to FIGS. 2 and 3, the pin member 90 is provided at the rear of the barrel 80. Pin 90 is preferably solid, and has a circular cross section with a smooth surface texture. Pin 90 affixes between the sides 82,81 at the respective recessed holes 91,93. Viewing FIG. 4, the length of pin 90 would be slightly greater than the width of either upper plate 92 or lower plate 86. The elastic loop member 120 can be seen in the FIG. 1 or 3B. The elastic loop member 120 is preferably a rubber band that is of the correct size and elasticity, and made of elastic material commonly known in the industry.

Regarding the FIG. 3, cocking apparatus 100 provides a recocking biasing member 106, a tube member 108, ram member 112, and a rod member 104. The recocking biasing member 106 is provided as an extension spring of suitable size, gauge diameter, and spring constant. Recocking biasing member 106 has a front bend at 105 and a rear bend at 107. The front bend 105 has a front leg 106*a*. Similarly, the rear bend 107 has a rear leg 106*b*. As shown, the rear bend and leg 107,106*b* is fixed at a hole 108*a* located at the rear and top of the tube 108. Moreover, viewing FIG. 3 and FIG. 8, the front bend and leg 105,106*a* are fixed at a hole 104*a* located on the front-bottom face of the rod 104.

Figure 8:
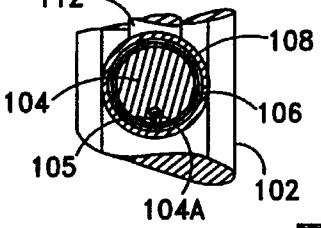
FIG. 8 is a sectional view looking from the front (refer to FIG. 3).

With reference to FIG. 2, the rod 104 is generally formed of solid material with flat-faced ends, a circular cross section, uniform diameter along the length, and a smooth surface appearance. Referring to FIG. 6, rod member 104 is affixed to the body 20 at the front face 102*c*. FIG. 3 and FIG. 8 shows the hole 104*a* located at the lower front face of rod 104. Hole 104*a* has a diameter that is slightly greater than the gauge diameter of a length of spring wire used to fabricate the recocking biasing member 106. Viewing FIG. 3, the depth of the hole at 104*a* is shown as being slightly greater than the length of the front leg at 106*a*.

The tube member 108 is provided at FIG. 2 and shown as a section of uniform round tubing with open ends, having an inside and outside diameter, suitable wall thickness, and smooth surface appearance both inside and out. The hole at 108*a* is oriented at the top and rear of the tube 108, and has a diameter that is slightly larger than the gauge diameter of spring wire used to fabricate the recocking biasing member 106. In addition, FIG. 3 shows that the preferable location of the hole 108*a* from the rear end of tube 108 is at a distance that is equal in magnitude to the length given by the bend at 107. Presented best in the FIGS. 3,6 or 8, the inside diameter of the tube 108 is slightly greater than the total diameter given by rod member 104 and twice the wire gauge of recocking biasing member 106.

FIG. 2 shows the ram member at 112 as preferably solid but can also be made hollow. Moreover, ram member 112 is shown affixed to the top portion of the tube member 108, and has a box-like cross section, smooth surface appearance on all sides, and uniform thickness. Additionally, FIGS. 2 and 3 show the ram 112 as made up of a front leg 114 and a rear leg 116. The rear leg 116 has a flat-faced end with a chamfered surface 116*a* towards the top. The front leg 114 shows a flat-faced end with no chamfer. As shown best by FIG. 3 and FIG. 6, the front leg 114 has a height that slightly less than the height of space provided between lower plate 86 and upper plate 92. Similarly shown by FIG. 3 and FIG. 7, the rear leg 116 has a height that is slightly less than the height of space provided between the upper plate member at 92 and the top surface 102*d* of base member 102. Provided best by FIG. 6, the uniform width of the ram 112 is shown to be slightly less then the magnitude of space provided between the side members 81,82 of barrel 80.

OPERATION—DRAWING SHEETS 1 TO 7

Figure 3A:
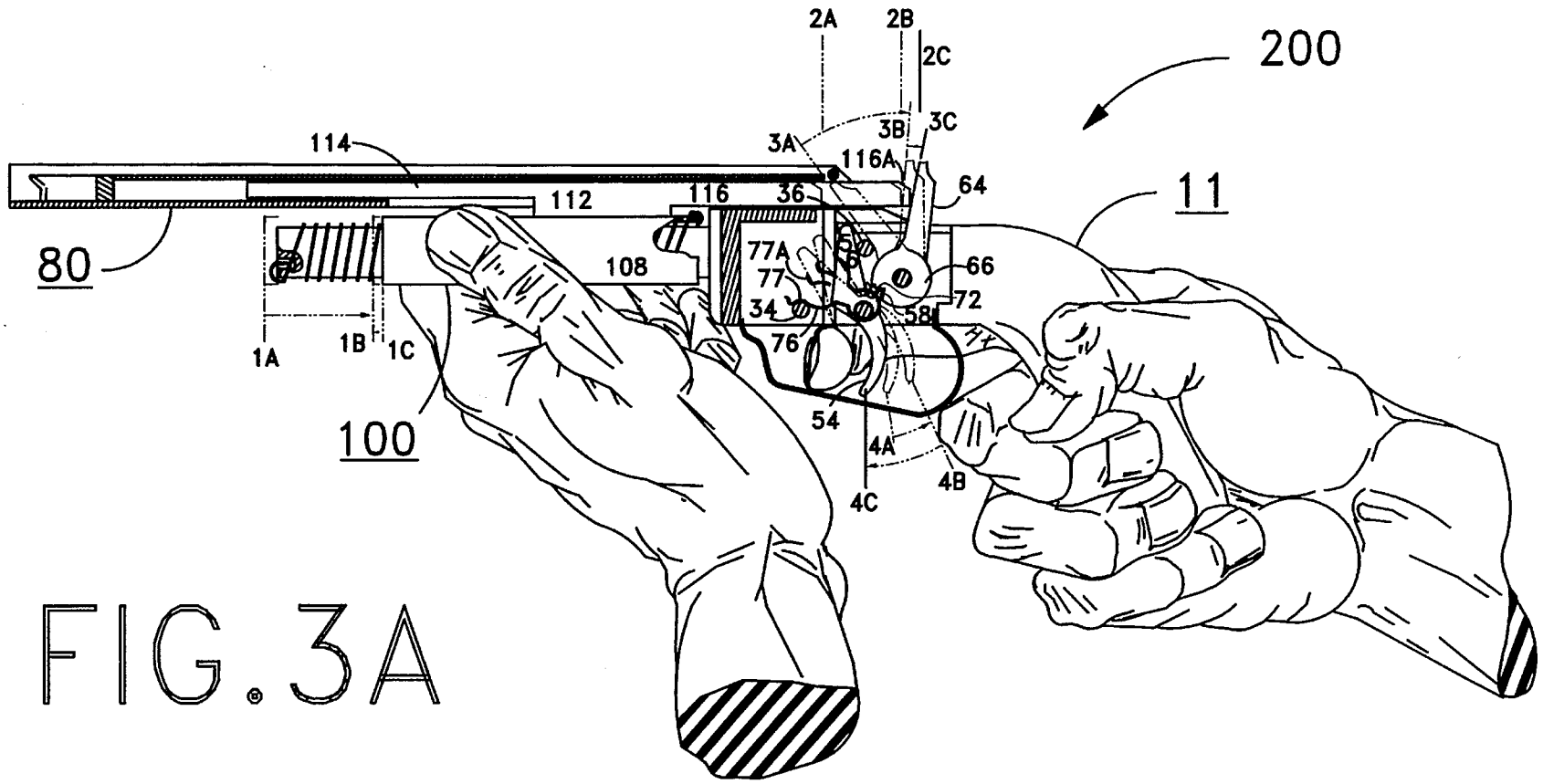
FIG. 3A is a side elevation view of the firearm being operated for "reset".
Figure 3B:
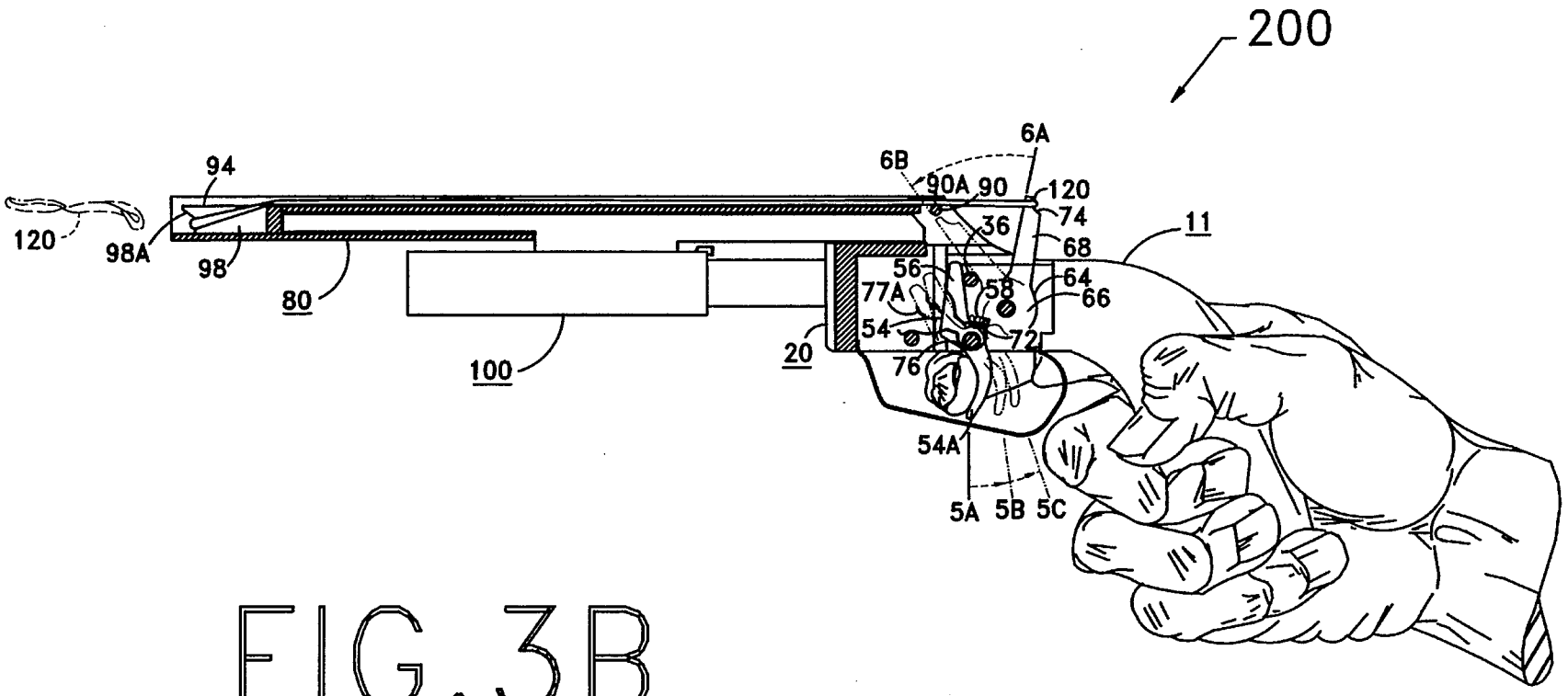
FIG. 3B is a side elevation view of the firearm being operated to "fire" the elastic loop member.

With regard to FIG. 3A, operation of simulated firearm 200 typically entails holding the stock 11 in one hand while using the other hand to pull back the tube member 108 of cocking apparatus 100. In so doing, the hammer or sear 64 and the trigger 54 are forcibly rotated to a "reset" mode where rotation ends with an intermesh of the parts, accompanied by an audible reverberation of sound similar to a "click!" as the trigger makes contact with the stop pin 36. Referring to FIG. 3B, an elastic loop member 120 is then stretched along the barrel 80 and secured at hammer 64 about curve 74. Upon manual operation of the trigger 54, elastic loop member 120 deploys as hammer 64 disengages with the trigger. Coincident with the deployment of elastic loop member 120, hammer 64 rotates to make hard and abrupt contact with stop pin 36, creating a distinctly audible reverberation of sound similar to a "snap!".

The ensuing discussion of function shall primarily reference the FIGS. 3, 3A, and 3B. Other figures provided, are referred to as specified.

Stock 11

As provided in the FIGS. 2 and 3, the stock 11 is shown with the curve 12, and flare 14 which, when taken collectively, function as suitable likenesses to the same or similar features found on the handle or hand-grip of conventional old-western revolvers. Viewing FIG. 5, the rased face 11*a* provides a suitable surface on which to attach the rear of trigger guard 42.

Body 20

Regarding FIGS. 2, body 20 provides the sides 22,32. As shown, sides 22,32 have lateral curvature 40*b* at the top-inner surface which necessitates a point of contact to secure the rear of barrel 80 at sides 81,82. Decorative chamfer 40 along the top and rear of sides 22,32 provide a realistic appearance as compared to the body or mid-section of a conventional old-western type revolver. The slope 40*a* towards the upper rear supplies the clearance necessary to properly stretch and secure elastic loop 120 onto hammer 64, and also provides a realistic appearance to the body 20.

With regard to FIG. 2 or FIG. 3, lateral member 28 and vertical member 30 serve to restrict the side-to-side movement of the respective hammer 64 and the trigger 54. Moreover, lateral member 28, and vertical member 30 assures that the respective hammer/trigger combination, which are floating members, will remain centered within the side panels 22,32. Rased surface 38 which is shown affixed to side panel 32, restricts the side-to-side movement of trigger 54, hammer 64, torque spring 76 and concentric spacers 50,52. Additionally, the rased surface 38 ensures that the trigger 54 and hammer 64 remain centered between the sides 22,32.

Regarding FIG. 9, there are the pin members 24,26. Pin 24 provides a center of rotation for the trigger 54 and the torque spring 76. Similarly, the pin 26 provides a center of rotation for the hammer 64. It can also be said that the pins 24,26 will provide a means with which the respective members 54/76 and 64 can achieve angular motion.

The torque spring pin member at 34 restricts the counter-clockwise movement of leg 77 of the elastic member 76. Torque spring pin 34 can also be said to prevent the full range of movement of the torque spring 76 by way of restricting the movement of lower leg 77.

The stop pin member 36 provides a means by which to restrict the full range of angular movement of both the trigger 54, and the hammer 64. The function of stop pin 36 is dependant upon whether firearm 200 is being operated for "reset" as depicted at FIG. 3A, or is being operated to "fire" as shown in FIG. 3B. Viewing FIG. 3B, when firearm 200 is operated for "fire", pin member 36 provides a "stop" as hammer 64 rotates in the counter-clockwise direction between position locators 6*a* and 6*b*. Shown in the FIG. 3A however, stop pin 36 now "stops" clockwise rotation of trigger 54 between locators 4*b* and 4*c*, as firearm 200 is operated for "reset".

Referring back to the FIG. 3, base member 102 of body 20 has a top surface at 102*d*. As firearm 200 is operated for reset as shown in FIG. 3A, top surface 102*d* will provide a suitable sliding contact surface for rear leg 116 of the ram 112, as tube 108 of cocking apparatus 100 is pulled back between locators 1*a* to 1*c*. Moreover, top surface 102*d* will restrict the downward movement of ram 112 at the rear leg 116. As seen in the FIG. 7, rear face 102*e* of base member 102 provides a suitable surface on which to attach the front of trigger guard 42. FIG. 6 shows that front face 102*c* of base 102 will provide a suitable mating surface for the rear of rod member 104.

Shown next in the FIG. 2, there are concentric spacers 50 and 52. The spacers 50,52 mount to respective pins 24,26, are positioned within respective recessed holes 22*a*,22*b*, and provide a "stop" to restrict the side-to-side movement of the respective trigger 54 and the hammer 64. Spacers 50,52 can also be said to ensure that the respective members 54,64, which are floating members, will remain centered within the side panels 22,32.

Viewing FIG. 9, the torque spring at 76 is provided as a torque spring that operates to resist the forced rotation of the respective hammer/trigger combination, 64/54. Torque spring 76 pivots about pin 24, and the legs 77 and 77*a* are wedged between the respective torque spring pin 34 and long leg 56 of trigger 54. FIG. 3A provides the "reset" sequence in which the tube member 108 of cocking apparatus 100 is manually translated rearward between position locators 1*a* and 1*b*. During the rearward motion of tube 108, the upper leg 77*a* of torque spring 76 is forced to resist a counter-clockwise rotation of the trigger 54 between the locators 4*a* and 4*b*, while lower leg 77 remains stationary at the torque spring pin 34. As tube 108 is moved to stroke's end from the locator 1*b* to locator 1*c*, the force permitting counter-clockwise rotation of trigger 54 approaches zero, thus allowing upper leg 77*a* to reposition (rotate) the trigger 54 clockwise from locator 4*b* to 4*c*. Viewing the FIG. 3B, manual rotation of the trigger 54 counter-clockwise between the locators 5*a* and 5*c* will force the leg 77*a* to rotate in the same direction as elastic loop 120 is deployed. Final resting position of torque spring 76 is shown in FIG. 3 or 9 where 76 is stressed in a partially compressed condition between torque spring pin 34 and leg 56 of trigger 54.

Referring to the FIG. 9, trigger 54 and hammer 64 are shown to be pivotally mounted to respective pins 24 and 26. The stressed leg 77*a* of torque spring 76 forces trigger 54 to make contact with hammer 64 as the tip of diagonal leg 58 meets the contour of eccentric section 66. During "reset" depicted by the FIG. 3A, trigger 54 will rotate counter-clockwise between the position locators 4*a* and 4*b* as tube member 108 is directed between 1*a* and 1*b*, and hammer 64 is directed from 3*a* to 3*b*. The end of stroke of tube 108 at the locator 1*c*, and the end of rotation of hammer 64 at 3*c*, permits the trigger 54 to rotate clockwise between 4*b* and 4*c*. Rotation of the trigger 54 ends at locator 4*c* as leg 56 makes abrupt contact with the stop pin 36. Contact between the leg 56, and the stop pin member 36 creates a reverberation of sound similar to a "click". As depicted by the FIG. 3B, manual operation of the trigger 54 via downwardly extended leg 54*a* between the locators 5*a* and 5*c* initiates the creation of a "snap" sound (discussed below).

During "reset" as depicted by FIG. 3A, hammer 64 will rotate clockwise between the locators 3*a* and 3*b* as tube member 108 is directed between 1*a* and 1*b*, and ram 112 is translated from position locator 2*a* to 2*b*. During the rotation of the hammer 64, notch 72 of eccentric section 66 is also rotated clockwise. As tube 108 reaches stroke's end at the locator 1*c*, the ram 112 will translate to 2*c*, and the hammer 64 will rotate to 3*c*. Final rotation of the hammer 64 between the locators 3*b* to 3*c* will position notch 72 to pass the trigger 54 at the tip of diagonal leg 58. At locator 3*c*, trigger 54 will interlock with the hammer 64 as the diagonal leg 58 meshes with the notch 72. Seen best by the FIG. 3B, the interlock between trigger 54 and hammer 64 is sustained by spring force as the upper leg 77*a* of torque spring 76 maintains leg 56 of trigger 54 against the stop pin member 36.

Referring to FIG. 3B, firearm 200 is operated for "fire". The hammer 64 is shown to be engaged with the trigger 54 at the notch 72. Moreover, hammer 64 is engaged with the rear end of the stretched or elongated elastic loop 120 at the recess 74. As the User operates the downward leg 54*a* of trigger 54 through the region marked by locators 5*a*,5*b*, the diagonal leg 58 is directed away from the notch at 72. Additional rotation of the trigger 54 between 5*b*,5*c*, frees the tip of diagonal leg 58 from the notch 72. At the instant whereby the tip of 58 is free of notch 72 the hammer 64, forced the stretched elastic loop 120, is immediately directed to rotate counterclockwise from locator 6*a* to 6*b*. The force of stretched elastic loop 120 dissipates with a loud reverberation of sound similar to a "snap!" as arm 68 of hammer 64 makes instantaneous and abrupt contact with the stop pin member 36.

Barrel 80

With regard to the FIG. 3, the barrel 80 has the sides 81,82 between which the fixed pin 90, the upper plate 92, the lower plate 86, and the front nose member 94 are rigidly fixed. Sides 81,82 are also shown with chamfered outside edges at 84. The chamfered edges provides authentic appearance to barrel 80 when compared to the barrel of a conventional old-western revolver. Moreover, the smooth inside surfaces of 81 and 82 help to guide the sliding movement of ram 112 and provide a restriction to the side-to-side movement of the member.

Viewing FIG. 2 and FIG. 3, there is the pin at 90 which is located towards the rear between sides 81 and 82, and fits into the respective recessed holes 93,91. At FIG. 3B, firearm 200 is ready for "fire" and the elastic loop member 120 is shown stretched between front nose 94 at the front, and curve 74 at the rear. Pin 90 makes contact with, and also supports stretched loop 120 at the point 90*a*. Moreover, pin 90 provides level alignment of stretched loop 120 between the point 90*a* and the point of contact at the curve 74 of hammer 64. By providing level alignment, pin 90 ensures that stretched loop 120 is deployed properly from firearm 200 during the "firing" sequence as depicted in phantom lines at FIG. 3B.

Referring to FIG. 3 or 4, upper plate member 92 is attached at the inner surface of sides 81,82, and provides a uniform width to barrel 80. The uniform width and smooth even surfaces of upper plate 92 necessitates easy translation of ram 112 from front to rear along barrel 80. The upper surface of ram 112 also provides an adequate "launching" surface for deployment of stretched elastic loop 120 as depicted in the respective FIG. 3B.

Viewing FIG. 2 or 3, lower plate 86 attaches to the inner surface of sides 81,82, supports front portion 114 of ram member 112, and aides to secure the front nose member 94. The uniform width and smooth surfaces of lower plate 86 necessitates easy translation fore and aft, between sides 81,82, of front portion 114 as ram 112 is operated during "reset" depicted in the FIG. 3A.

Front nose member 94 has the base 96, and tip member 98. Viewing the FIG. 3, tip member 98 affixes to the front of barrel 80, and has sloped notch 98*a*. Sloped notch 98*a* provides an easy-access location at the front of barrel 80 on which elastic loop member 120 may be secured and stretched as firearm 200 is prepared for "fire" as shown in the FIG. 3B. Referring back to FIG. 3, chamfers 98*b* along the edges of sloped notch 98*a* ensures that no sharp corners exist on tip 98 which would rip or otherwise damage stretched elastic loop 120.

Base member 96 is secured to the lower plate 86 and provides a "stop" or point of restriction for the front portion 114 of the ram 112. As shown in the FIG. 3, spring energy stored within the recocking biasing member 106 imparts forward-directing force on tube 108 to which ram 112 is attached. Spring force of member 106 is balanced by an equal force imparted by base 96, and applied to the front portion 114.

Elastic loop member 120 provides the projectile to be "fired" as shown in the FIG. 3B. Elastic loop 120 is manually stretched from the front of firearm 200 at notched curve 98*a* of [nose] tip 98, to the rear at curve 74 of hammer 64. As trigger 54 is manually operated between the position locators 5*a* to 5*c*, hammer 64 will rotate between 6*a* and 6*b* and stretched elastic loop 120 is freed from curve 74. Elastic energy stored within the stretched elastic loop 120 will allow immediate deployment and projection away from firearm 200 as shown in phantom lines in the FIG. 3B.

Cocking Apparatus 100

Referring to FIG. 3, the cocking apparatus at 100 provides the recocking biasing member 106, rod member 104, tube member 108, and ram member at 112.

The recocking biasing member 106 operates as an extension spring of predetermined size, gauge diameter, and spring constant. For firearm 200, recocking biasing member 106 has the bends/legs 105/106*a*, 107/106*b* at respective front and rear. The bends and legs will ensure that elastic member 106 is secured firmly to the respective rod 104 in hole 104*a* at the front, and tube 108 in hole 108*a* at the rear. Moreover, recocking biasing member 106 fits loosely between the outside surface of rod 104, and inside surface of tube 108 so as to necessitate unimpeded elongation during the "reset" sequence as depicted in FIG. 3A. As shown in the FIG. 3, recocking biasing member 106 is slightly stressed or elongated. Elongation of 106 imposes a forward-pointing spring force on the tube member 108 via the hole 108*a* located at the rear. Shown in the FIG. 3A, as cocking apparatus 100 is operated, tube member 108 is translated rearward between position locators 1*a* and 1*c*, as member 106 is further elongated. Increased elongation of the recocking biasing member 106 creates increased spring force that is directed opposite to the direction of elongation, and ensures that apparatus 100 will return to the position as shown in FIG. 3.

Regarding the FIG. 3, tube member 108 has hole 108*a* at the top and rear which provides a suitable anchor for the rear bend and leg 107, 106*b* of recocking biasing member 106. Moreover, tube 108 provides a point of attachment for the bottom-central surface of ram 112, and houses and protects the recocking biasing member 106. Forward-pointing spring force of slightly stressed elastic member 106 is transferred to ram 112 through the tube 108. As shown in FIG. 3A, tube 108 provides a means by which the User can manually operate cocking apparatus 100 to "reset" firearm 200. As depicted, translation to tube 108 rearward between position locators 1*a* to 1*c* positions ram 112 from locators 2*a* to 2*c*, and forcibly rotates hammer 64 and trigger 54 into a "ready"

position. Increased spring force stored within recocking biasing member 106 will then reposition the tube 108 to the location as shown in the FIG. 3 or 3B.

The rod member 104 has a hole 104*a* at the front, and is affixed at the rear to vertical front face 102*c* of base member 102. Hole 104*a* provides an anchor for the front bend and leg 105,106*a* of elastic member 106. Viewing the FIG. 3A, as firearm 200 is operated for "reset", rod 104 provides a sliding contact surface by which to guide the assembly made up of elastic member 106 and tube 108.

DESCRIPTION—DRAWING SHEETS 8 TO 14

Referring to FIG. 10, an alternate simulated firearm is shown pictorially at 400. The alternate embodiment of firearm 400 is shown as an invention primarily to find utility as a "snap-toy" for small children, and simulates a modern hand gun or semi-automatic pistol. For descriptive and illustrative purposes, the firearm 400 is shown to be formed of a number of primary parts which are intern sub-assembled into sub-parts. Included among the primary parts are left and right shallow dish-like moldings 124 and 126, a barrel member 80', and a cocking apparatus 100'. The primary parts and sub-parts which make them up may be formed of wood, various types of plastic or suitable materials as specified. Final assembly of the parts, or variations of same, would be directed by any economical or convenient means known in the art.

The ensuing description of firearm 400 shall identify some part numbers with a "prime" after the number. The "prime" identifies the part has having the same or similar form as the same part number provided and described among the FIGS. 1 through 9A for the firearm 200.

Sides 124,126

As shown in the FIG. 10, the left side 124, and the right side 126 are preferably formed of plastic plate which has been stamped or otherwise manipulated to acquire identical half-forms depicting the general structure of a modern hand gun or semi-automatic pistol. Comprising the elements of structure stamped or molded into the sides 124,126 are respective half-forms of a stock or hand grip 11' a body or mid-section 20', a rod sheath 140, and a slider guide 142. The aforementioned half-forms of the sides 124 and 126 are shown to be mated together at central seam 166.

Referring now to FIG. 10A, the half-forms of the stock 11' are provided with a hole 122 at the bottom-center, and a hole 123 at the top-center. Viewing the FIG. 10D, the holes 122,123 are shown as integrated tubular extensions that have a depth equal to the width of either the left or right molds of stock 11'. The diameter of the holes at 122 and 123 are provided to be of a size to ensure a snug fit with uniform pin-like members used to make the respective parts 136 and 138 (discussed next).

Introduced in the FIG. 10A or 10D is depicted a pin member 136, and a pin member 138. The pins 136,138 are each formed of smooth rod-like material that has a uniform cross section, and flat-faced ends. The length of the pins are preferably equal, and have a magnitude that is slightly less than the full width of the stock 11' upon the attachment of sides 124 and 126 along the seam 166. The diameter of the pins 136,138 are of a size to ensure a snug fit with the respective holes 122, 123 of the stock 11'.

Viewing FIG. 10D, either side 124 or 126 shows the body 20' to be integrated with the stock 11' among the rear, the rod sheath 140 along the front, and slider-guide 142 along the top. The parts comprising body 20' include a trigger guard 42' and a base member 102'. The base member 102' is preferably made solid, and has a sliding contact surface 102*d'* at the top that is level and smooth. Viewing FIG. 10E, the base member also has a vertical front face 102*c'* which is plumb and smooth. Additionally, body 20' provides a series of holes 38*a'*, 38*b'*, and 38*c'* on each side. The holes 38*a'*, 38*b'*, 38*c'* are shown to fully penetrate the sides 124 and 126, and each has a diameter that is of a size to ensure a snug fit with uniform pin-like material used to form the respective members 24',26',34' (discussed next). The specific positioning of the holes 38*a'*,38*b'*,38*c'* on the body 20' are preferably identical to the positioning of respective holes 38*a*,38*b*,38*c* of the body 20 on the firearm 200 (see FIGS. 3 and 9A).

Continuing with FIG. 10D, affixed between the mated sides 124,126, are a group of pin members 24', 26', and 34'. The pins are formed of the same rod-like material provided for either of the pins 136 or 138, and have a diameter that creates a snug fit with respective holes 38*a'*, 38*b'*, and 38*c'*. The length of the pins 24',26',34' are slightly less than the width of body 20' upon attachment of the sides 124 and 126 along the seam 166.

Mounted on pin 24', and trapped between the half-forms of the body 20' is a trigger 54' and an torque spring 76'. Both the trigger 54', and the torque spring 76' have the form and appearance virtually identical to respective trigger 54 and torque spring 76 as specified for the firearm 200, and shown in the FIG. 9. Allowing the FIG. 9 for reference with the FIG. 10D, trigger 54' has a upwardly-extending leg 56', an upwardly diagonal leg 58', a downwardly-extending leg 54*a'*, and a hole 55' located centrally at the point of intersection of the legs 56', 58', and 54*a'*. The torque spring 76' provides a outwardly-pointing lower leg 77', an outwardly pointing upper leg 77*a'*, and a central section 77*b'* located at the base connecting legs 77' and 77*a'*. The lower leg 77' has a bend 76*a'* at the tip. Similarly, the upper leg 77*a'* has a bend 76*b'* at the tip. The torque spring 76' is shown to be situated very loosely about pin member 24' at central section 77*b'*, and legs 77',77*a'* are wedged or trapped via respective bends 76*a'*,76*b'*, between respective torque spring pin member 34' and long leg 56' of trigger 54'.

Similarly, located within body 20' and mounted to pin 26' is a hammer or sear 64', and an torque spring 78. The hammer 64', and the torque spring 78 have the general form and appearance of the respective hammer 64 and torque spring 76 as specified for the firearm 200 (see FIG. 9). Hammer 64' provides an upwardly extending arm 68', a eccentric section or central hub 66', a notch 72', and a hole 70'. The torque spring 78 provides a leg 79, a leg 79*a*, and a central section 79*b*. The leg 79' has a bend 78*a* at the tip, and the leg 79*a* has a bend 78*b* at the tip.

The trigger 54', and the hammer or sear 64' of firearm 400 are physically dimensioned and interrelated according to the respective trigger 54 and hammer 64 shown in the FIG. 9A for firearm 200.

Introduced by the FIGS. 10A and 10D, the half-forms of the rod sheath are shown at 140. Rod sheath 140 is an elongated, smooth tubular member with a closed, flat-faced end towards the front. Moreover, sheath 140 is integral with the respective half-forms of the base 102' of body 20' towards the rear. Viewing FIGS. 10A and 10D with 10G, there is provided a straight and slender slot 144 that extends laterally among the top-rear of rod sheath 140. The lateral length of the slot 144 would be slightly greater than one-half the lateral length of the rod sheath 140. Viewing FIG. 10F, the slot 144 has a width that is slightly larger than the width of a plate-like member used to form the part 160 (discussed later).

FIG. 10, 10A or 10D shows the slider-guide at 142. Slider-guide 142 is integrated with stock 11' and body 20' at a lower ledge 130 to the left and right sides. Viewing FIG. 10J, the width of slider-guide 142 is slightly less than the width between two sides of a "U"-shaped plate used to make the part no. 108' (discussed later). A slot 148 extends laterally and along the top of slider guide 142. Slot 148 is shown to be equally wide, but preferably only one-third as long as slider-guide 142. Depicted in FIG. 10D or 10I, integrated as part of the slider-guide 142 is vertical face or stop face 17'. Vertical face 17' is shown as plumb and smooth. Moreover, FIG. 10D shows that along the sides and towards the front of slider-guide 142 there is depicted the respective lower ledge 130, and a hole 38*d'*. The hole at 38*d'* has a diameter that is equal to the diameter of any of the holes 34*a'*,38*b'*,38*c'* found on the body 20'. In addition, the position of hole 38*d'* among the holes 34*a'* through and 38*c'*, is equivalent to the positioning of respective hole 38*d* among the holes 38*a* through 38*c*, for the firearm 200 (see FIGS. 3 and 9). As shown in FIGS. 10A, 10I or 10J, the lower ledge 130 extends the full length of the slider-guide 142 and is slightly wider than the width (thickness) of thin plate material used to form the sides of part 108' (discussed later).

Barrel 80'

As shown at FIG. 10A, 10E or 10J, the barrel at 80' is formed of a open-ended tube section having a uniform arch-like cross section along the length. The length of barrel 80' is provided as two-thirds that of the rod sheath 140, and the outer width is slightly less than the width provided between the sides of a uniformly thin "U" plate used to form the part 108' (discussed later). The inner width of barrel 80' is slightly greater than the width of a uniformly thin rod-like member used to form part no. 114' (discussed later). FIG. 10A clearly shows a connector 146 depending downward and from the rear of barrel 80'. Connector 146 is preferably formed of uniformly thin plate material that is shaped with a straight and level lower edge. The lower edge of connector 146 is affixed to the central-top and center of rod sheath 140. The vertical height of the connecter 146 is such as to position the top outer edge of barrel 80 laterally level with the top outer edge of slider-guide 142.

Cocking Apparatus 100'

Pictorially, the cocking apparatus 100' is shown in FIG. 10. With reference made to the elevation view of FIG. 10A, components comprising cocking apparatus 100' include a slider-cock 108', a ram 112', a recocking biasing member 106', and a rod member 104'. The slider-cock at 108' is generally formed of a thin plastic or metal plate that has been bent or stamped into an elongated member having a uniform cross section similar to an upside down "U" with left and right sides, and a flat level top. Viewing FIG. 10E, the slider-cock 108' provides a concave chamfer 152 on either side towards the bottom-front, a sight indicator 156 at the front and center on top, and a front-end cap 162. The concave chamfer on either side at 152, the sight indicator at 156, and the front-end cap 162 may be formed as integral members of slider-cock 108'. The physical dimensions of the parts 152,156,162 are similar to those of the respective members on the cocking apparatus of a conventional hand gun or semi-automatic pistol. Viewing FIGS. 10A and 10I, either side of the slider-cock 108' has a series of slightly sloped vertical lines 154 towards the rear, and a decorative chamfered edge 158 along the top. The physical dimensions of the sloped vertical lines at 154 would match a similar feature provided on the cocking apparatus of most modern hand guns or semi-automatic pistols. The chamfered edge at 158 extends the full length of slider-cock 108' and matches in appearance, a similar feature found on the cocking apparatus of most modern hand guns or semi-automatic pistols.

Referring to the FIGS. 10A and FIG. 10J, the ram 112' is provided and affixed to the inner-central surface of slider-cock 108' via an upper lateral edge 168. Ram 112' may be made solid or can be hollow, and has uniform thickness. Moreover, ram 112' shows a front or forward portion at 114', a rear portion 116', and a lower portion 160. Viewing the FIG. 10A, 10E or 10J, the front portion 114' is formed as an elongated rod having a uniform cross section and a surface contour to match the inner contour of barrel 80'. The length of front portion 114' is preferably less then the length of the barrel 80', and towards the rear, member 114' is integral with the ram 112'. The integration of 114' with 112' produces a respective upper and lower vertical lip at 170 and 171. Best seen in FIG. 10A, the upper,lower lips 170,171 are of equal vertical height which is slightly greater than the wall thickness tube material which forms the barrel 80'.

The rear portion 116' of ram 112' comprises a flat vertical face at 116*a'* that extends upwardly to intersect a rear-end extension 164. The rear-end extension 164 is level and smooth, and integrates with ram 112 at corner 172. Corner 172 has a height preferably equal to that provided by either vertical lip 170 or 171.

With reference made to the FIG. 10A, the lower portion or tab 160 is provided. Lower portion or tab 160 depends downward from to the ram 112' via the lower vertical lip 171 at the front, and a corner 174 at the rear. Lower portion 160 provides a hole 176 at the rear towards the bottom-center. Hole 176 has a diameter that is slightly greater than the gauge diameter of a length of spring wire used to make the recocking biasing member 106' (discussed next). The depth of the hole at 176 is slightly greater than the length of a rear leg at 106*b'* (discussed next).

As shown by the FIG. 10A, recocking biasing member 106' is given as an extension spring of suitable size, gauge diameter and spring constant. The member 106' has a front bend at 105', and a rear bend at 107'. The front bend 105' has a front leg 106*a'*. Similarly, the rear bend 107' has a rear leg 106*b'*. As provided, the rear bend and leg 107',106*b'* are fixed at the hole 176. Moreover, the front bend and leg 105',106*a'* are fixed at a hole 104*a'* located on the front and bottom face of the rod member 104'.

The rod 104' is generally formed of solid material having flat-faced ends, a uniform circular cross section, and a smooth surface appearance. Referring to the FIG. 10E, the rod 104' is affixed at the rear end to body 20' via vertical face 102*c'*. FIGS. 10A and 10E shows the hole 104*a'* to have a diameter that is slightly greater than the gauge diameter of the length of spring wire used to form recocking biasing member 106'. The depth of the hole 104*a'* is shown as being slightly greater than the length of the front leg 106*a'*.

OPERATION—DRAWING SHEETS 8 TO 14

With regard to the FIG. 10B, operation of firearm 400 typically entails holding the stock 11' in one hand while using the other hand to pull back the sliding-cock 108' of the cocking apparatus 100'. In so doing, hammer 64' and trigger 54' are forcibly rotated to a "reset" mode where rotation ends with an intermesh of the parts, accompanied by a reverberation of sound similar to a "click!". Referring to FIG. 10C, upon manual operation of the trigger 54', hammer 64' disengages from the trigger, and is forced to rotate to a stop at pin 36'. Upon contact between the hammer 64' and stop pin 36', a loud reverberation of sound is created that is very similar to a "snap!".

The ensuing discussion of function shall primarily reference FIGS. 10A, 10B, and 10C. Other FIGS. provided, are referred to as specified.

Sides 124,126

As provided in FIGS. 10 and 10D, the sides 124 and 126 comprise respective half-forms of the stock 11', trigger guard 42', body 20', rod sheath 140, and the slider-guide 142. These images stamped or molded into the sides 124,126 are preferably provided to function as simulations of the same or similar features found on most conventional hand guns or semi-automatic pistols, and thus provides authenticity of appearance to firearm 400.

Viewed best by FIG. 10D, the holes 122 and 123 on the stock 11' function as anchor points to secure respective pin members 136 and 138. The elongated form of holes 122,123 ensures that the individual half-forms that are sides 124, and 126 will mate properly at the seam 166.

The body 20' is shown to provide the series of holes 38*a*' through 38*c*', along with the base member 102'. The holes 38*a*', 38*b*', and 38*c*' function as anchor points for the respective pin members 24', 26', and 34'. The base member 102' provides the vertical front face 102*c*' and top surface 102*d*'. Vertical front face 102*c*' provides a surface by which the rear-end of rod sheath 140 is formed. With reference to FIG. 10B, the top surface 102*d*' provides a point of sliding contact for the lower edges of cocking ram 112' as cocking apparatus 100' is operated to place firearm 400 in "reset" mode.

The slider-guide 142 provides the hole 38*d*', the vertical face or stop face 17', and the lateral surface 130. Hole 38*d*' provides an anchor point for the respective stop pin 36'. With reference to FIG. 10I, vertical face 17' functions as "stop" or point of restriction for the rear leg 79 of the torque spring 78. As shown in FIG. 10B, the lateral surface at 130 serves to provide a point of sliding contact for the lower right and left edges of slider-cock 108' as cocking apparatus 100' is operated to place firearm 400 in "reset" mode.

Pin members 24', 26', 34', and 36' are all affixed between the sides 124,126 with each member providing a separate function. The pin member 24' functions as a center of rotation for the respective trigger 54', and torque spring 76'. Similarly, the pin member 26' provides a center of rotation for hammer 64', and the torque spring 78. Stop pin member 34' provides a "stop" or point of restriction for the leg 77' of torque spring 76'. The stop pin 36' has a dual function. As seen in the FIG. 10A, pin 36' functions as a "stop" to limit the angular travel of hammer 64' in the counter-clockwise direction. As provided in the FIG. 10C however and prior to "fire" of firearm 400, the pin 36' is shown to "stop" the angular travel of trigger 54' in the clockwise direction.

Referring to the FIG. 10D, torque springs 76' and 78 operate to resist the predetermined rotation of the respective trigger 54', and hammer 64'. As shown by FIG. 10D, the torque spring 76' pivots about the pin 24', and the legs 77' and 77*a*' are wedged between the respective torque spring pin 34' and upward leg 56' of the trigger 54' via respective bends 76*a*',76*b*'. FIG. 10B provides the "reset" sequence in which the slider-cock 108' of cocking apparatus 100' is manually translated rearward between the position locators 1*a*' and 1*b*'. During the rearward translation of the slider-cock 108', the leg 77*a*' of torque spring 76' is forced to resist a counter-clockwise rotation of the trigger 54' between the position locators 4*a*' and 4*b*', while leg 77' remains stationary at the torque spring pin 34'. As slider-cock 108' is moved to stroke's end from locator 1*b*' to locator 1*c*', the force permitting counter-clockwise rotation of trigger 54' approaches zero, thus allowing leg 77*a*' to reposition (rotate) the trigger 54' from locator 4*b*' to 4*c*'. Viewing the FIG. 10C, manual rotation of the trigger 54' counter-clockwise between the locators 5*a*' and 5*c*' will force the leg 77*a*' to rotate in the same direction, and subsequently achieve steady-state at rest in a partially stressed condition as depicted by the FIG. 10A.

Similarly shown by the FIG. 10D, torque spring 78 pivots about the pin 26', and legs 79, and 79*a* are wedged between the respective vertical face 17', and the upward arm 68' of hammer 64' via respective bends 78*a*,78*b*. FIG. 10B provides the "reset" sequence, and as the slider-cock 108' is manually positioned from the locator 1*a*' to the locator 1*c*', leg 79*a* of torque spring 78 is forced to resist a clockwise rotation of the hammer 64' between the position locators 3*a*' and 3*c*', while the leg 79 remains stationary at the vertical face 17'. Viewing the FIG. 10C, manual rotation of the trigger 54' between the locators 5*a*' and 5*b*' will allow a forced rotation of hammer 64' between locators 6*a*' and 6*b*' as leg 79*a* expends spring energy to the hammer. The end of rotation of hammer 64' at the position locator 6*b*' allows the leg 79*a* to remain at rest in a partially stressed condition as shown in the FIG. 10A.

Referring to the FIG. 10D, trigger 54' and hammer 64' are shown to be pivotally mounted to respective pins 24' and 26'. Viewing FIG. 10B, the stressed leg 77*a*' of torque spring 76' forces trigger 54' to make contact with hammer 64' as the tip of diagonal leg 58' meets the contour of central hub 66'. During "reset" depicted by the FIG. 10B, trigger 54' will rotate counter-clockwise between the position locators 4*a*' and 4*b*' as slider-cock 108' is directed between 1*a*' and 1*b*', and hammer 64' is directed from 3*a*' to 3*b*'. The end of stroke of slider-cock 108' at the locator 1*c*' and the end of rotation of hammer 64' at 3*c*', permits the trigger 54' to rotate clockwise between 4*b*' and 4*c*'. Rotation of trigger 54' ends at locator 4*c*' as long leg 56' makes abrupt contact with the stop pin 36'. Contact between the long leg 56' and the stop pin member 36' creates a reverberation of sound audible as a "click". As depicted by the FIG. 10C, manual operation of the trigger 54' via downward leg 54*a*' between the locators 5*a*' and 5*c*' aides to create a "snap!" sound. The creation of the "snap!" sound also allows the trigger 54' to reside or come to rest in the position as depicted in the FIG. 10A.

Viewing FIG. 10A (with FIG. 10D as reference for part numbers), the stressed leg 79*a* of torque spring 78 forces hammer 64' to make contact with trigger 54' as the contour of central hub 66' meets the tip of diagonal leg 58'. During "reset" as depicted by the FIG. 10B, hammer 64' will rotate clockwise between the locators 3*a*' and 3*b*' as slider-cock 108' is translated between 1*a*' and 1*b*', and cocking ram 112' is translated from position locator 2*a*' to 2*b*'. During the rotation of the hammer 64', notch 72' is also rotated clockwise. As slider-cock 108' reaches stroke's end at the locator 1*c*', the cocking ram 112' will translate to 2*c*', and the hammer 64' will rotate to 3*c*'. Final rotation of the hammer 64' between the locators 3*b*' to 3*c*' will position notch 72' to pass the trigger 54' at the tip of diagonal leg 56'. At locator 3*c*', trigger 54' will interlock with the hammer 64' as the diagonal leg 56' meshes with the notch 72'. The interlock between trigger 4' and hammer 64' is sustained by spring force as the leg 79*a* of torque spring 78 is highly stressed against the straight leg 68'.

Barrel 80'With regard to the FIG. 10A, barrel 80' is shown. The Barrel 80' simulates the tubular barrel member of a conventional hand gun or semi-automatic pistol. Towards the rear of barrel 80', there is provided the vertical connector 146. Connector 146 functions to attach or joint the rear of barrel 80' to the top-center of rod sheath 140, and also locates the barrel in a laterally level position with the top of slider-guide 142.

The uniform U-like cross section of barrel 80' provides a sliding contact surface for both the front portion 114' of ram 112', and the top-inner surface of slider-cock 108' as these members translate fore and aft when firearm 400 is operated for "reset" as depicted in the FIG. 10B.

Cocking Apparatus 100'

Viewing 10A, cocking apparatus 100' comprises the slider-cock 108', ram 112', recocking biasing member 106', and rod member 104'. Slider-cock 108' is an elongated member with uniform upside down "U" cross section providing similar appearance to the slider-cock of a conventional semi-automatic pistol. Side chamfers 158, sloped vertical lines 154, sight indicator 156, and front-end cap 162 are also provided with slider-cock 108' and each are similar in appearance to conventional features found on most semi-automatic pistols. Depicted by the FIG. 10B, as firearm 400 is operated for "reset", slider-cock 108' is manually translated rearward between position locators 1*a*' and 1*c*'. FIG. 10C shows the slider-cock 108' to have returned to the original position as also depicted in FIG. 10A. Viewing FIG. 10B, smooth and level fore and aft operation is achieved as slider-cock 108' is guided by the barrel 80' towards the front, and ledge 130 of slider-guide 142 towards the rear.

With reference to FIG. 10A, the ram member 112' is affixed to the top-inner surface of the slider-cock 108' at attachment point 168. Ram 112' is shown to have the front or forward portion 114', the rear portion 116', and the lower or tab portion 160. As shown in FIGS. 10J, 10B, the positioning of ram 112' centrally between sides 124,126 provides and maintains level alignment as firearm 400 is operated for "reset", and sliding contact is made between front portion 114' and respective barrel 80', and rear portion 116' and respective flat surface 102*d*'. Moreover, rear portion 116' has the rear-end extension 164. As viewed by the FIG. 10A or 10B, rear-end extension 164 will trap and align rear portion 116' between the flat surface 102*d*' and the top-inside surface of the slider guide 142 as the cocking apparatus 100' is operated for "reset" and ram 112' is translated between 2*a*' and 2*c*'. FIG. 10A shows the lower portion or tab portion 160 of the ram 112'. Lower portion 160 provides hole 176 towards the bottom-center which provides a suitable anchor point to secure the rear leg 106*b*' of recocking biasing member 106'.

Regarding the FIG. 10A, recocking biasing member 106' functions as an extension spring of predetermined size, gauge diameter, and spring constant. The recocking biasing member 106' has the front bend and leg 105',106*a*' to attach at the front face of rod member 104' via hole 104*a*'. Similarly, the rear bend and leg 107',106*b*' attaches at lower portion 160 of ram member 112' via hole 176. Provided in the FIG. 10A, recocking biasing member 106' is in a partially stressed condition by being fixed between ram 112' at the rear, and rod 104' at the front. As shown, partially stressed recocking biasing member 106' forces firm contact respectively, between the corners 170,171 of ram 112', and the rear face of barrel 80'. As shown in the FIG. 10B during the "reset" sequence of the firearm 400, ram 112' translates rearward between position locators 2*a* and 2*c*. During translation of ram 112', recocking biasing member 106' is increasingly stressed as rear leg 106*b*' translates with lower portion 160, while front leg 106*a*' remains stationary at the front of rod member 104'. Depicted in the FIG. 10C or 10A, stored spring force provided by stressed recocking biasing member 106' rapidly repositions (translates) the ram 112' forward again, to remain at rest as upper and lower vertical lips 170,171 meet the rear face of barrel 80'.

Viewing the FIGS. 10E, 10G, the rod member 104' is provided. Rod 104' is affixed at the rear to flat face 102*c*' of body 20', and has the hole 104*a*' on the central-bottom face at the front. As shown best in the FIG. 10A, the front bend and leg 105',106*a*' of recocking biasing member 106' are fixed at the hole 104*a*'. Viewing the FIG. 10B with firearm 400 operated for "reset", hole 104*a*' maintains 105',106*a*' in a fixed position while rod 104' maintains level and smooth elongation of recocking biasing member 106' as ram member 112' is translated between the position locators 2*a*' and 2*c*'. As ram member 112' returns to rest as depicted by FIG. 10A, rod member 104' maintains recocking biasing member 106' in a partially stressed state via the anchor point at hole 104*a*', and also aides to maintain level alignment of the elastic member 106'.

The foregoing description and operation of the simulated firearm 200, describes the form and function of the preferred embodiment as illustrated, together with a possible variation of same as shown by the simulated firearm 400. Further, since numerous modifications and changes will readily be realized to those skilled in the art, it is not desired to limit the simulated firearm 200 or 400 to the exact construction and operation shown and described in this patent. Accordingly, all suitable modifications and variations in addition to those as presented, that fall within the scope and spirit of the invention, may be resorted to.

I claim:

1. A simulated hand held firearm for deployment of an elastic loop band, comprising:

(a) a frame including a body, a handle, and an elongated barrel;

(b) means at the barrel front to receive an elastic band;

(c) a sear member pivotally mounted in said body at the barrel rear for pivotal movement in a plane parallel to the barrel, said sear member comprising a central hub with a hole to receive a pivot pin, and a notch in its periphery, and a generally upwardly extending arm to receive the elastic band thereover;

(d) a trigger member pivotally mounted in said body adjacent to said sear member for pivotal movement in the plane parallel to the barrel, said trigger member comprising a central hub with a hole to receive a pivot pin, a generally upwardly extending leg which engages a stop to limit rotation of the trigger member, a generally upwardly diagonal leg which engages the notch of the sear member to lock the sear member from rotation, and a generally downwardly extending leg for actuation by the user's finger, the trigger being biased to pivot so that the diagonal leg engages the notch until the downward leg is actuated by a user;

(e) cocking means operable to pivot the sear member rearward until the upwardly extending arm is in an elastic band holding position and the diagonal leg of the trigger is aligned with the notch of the sear member, causing them to interlock, whereby actuation of said trigger by the user causes said diagonal leg and notch to disengage, allowing the sear to pivot forward to a release position to release the elastic band.

2. The simulated firearm of claim 1, in which said trigger member is biased with a torque spring with a lower leg which engages a torque spring pin fixed in said body, a central section which encircles said trigger pivot pin, and an upper leg which engages said generally upwardly extending leg of said trigger member.

3. The simulated firearm of claim 1, in which said cocking means comprises:

(a) a rigid rod member fixed to said 'body' and extending forward, parallel to and below the barrel;

(b) a tube member of inside diameter larger than the outside diameter of said rigid rod member;

(c) recocking biasing means in the space between the rigid rod outer diameter and the tube member inner diameter, said recocking biasing means connected to the rigid rod member and tube member to bias the tube member forward to a rest position so that a space is left between the tube member and the body;

(d) a ram member connected to the top of the tube member, said ram member extending rearward toward said upwardly extending arm of said sear member, whereby when the upwardly extending arm of the sear member is in the release position, and said tube member does not contact said upwardly extending arm, but when a user pulls said tube member rearwardly against said recocking biasing means, said ram member contacts said upwardly extending arm to pivot it rearwardly to said elastic band holding position.

4. The simulated firearm of claim 1, in which said stop is located between said generally upwardly extending leg of said trigger member, and said generally upwardly extending arm of said sear member, and is also engageable by said generally upwardly extending arm to limit rotation of the sear member.

5. The simulated firearm of claim 1, in which said barrel includes a forward nose to receive said elastic band.

6. The simulated firearm of claim 1, wherein said generally upwardly extending arm of said sear member comprises a recess to receive said elastic band.

7. A simulated hand held firearm for mimicking the mechanical operations and sounds of a conventional hand held firearm, comprising:

(a) a frame comprising a body, a handle, and an elongated barrel;

(b) a sear member pivotally mounted in said body at the barrel rear for pivotal movement in a plane parallel to the barrel, said sear member comprising a central hub with a hole to receive a pivot pin, and a notch in its periphery, and a generally upwardly extending arm;

(c) means to bias said sear member so that said upwardly extending arm pivots forward;

(d) a stop means mounted in said body to stop forward pivoting of said upwardly extending arm, said stop means being of a rigid material so as to create an audible sound when said upwardly extending arm forcefully contacts it under bias of said biasing means;

(e) a trigger member pivotally mounted in said body adjacent to said sear member for pivotal movement in the plane parallel to the barrel, said trigger member comprising a central hub with a hole to receive a pivot pin, a generally upwardly extending leg which engages a stop to limit rotation of the trigger member, a generally upwardly diagonal leg which engages the notch of the sear member to lock the sear member from rotation, and a generally downwardly extending leg for actuation by the user's finger, the trigger being biased to pivot so that the diagonal leg engages the notch until the downward leg is actuated by a user;

(f) cocking means operable to pivot the sear member rearward until the upwardly extending arm is in a rear position out of contact with said stop means and the diagonal leg of the trigger member is aligned with the notch of the sear member, causing them to interlock, whereby actuation of said trigger by the user causes said diagonal leg and notch to disengage, allowing the sear to pivot forward to contact said stop means to create a sound which simulates a real firearm.

8. The simulated firearm of claim 7, in which said trigger member is biased with a torque spring with a lower leg which engages a torque spring pin fixed in said body, a central section which encircles said trigger pivot pin, and an upper leg which engages said generally upwardly extending leg of said trigger member.

9. The simulated firearm of claim 7, in which said sear member is biased with a torque spring with a rear leg which engages a stop face in the body, a central section which encircles said sear pivot pin, and a front leg which engages said generally upwardly extending arm of said member.

10. The simulated firearm of claim 7, in which said stop is located between said generally upwardly extending leg of said trigger member, and said generally upwardly extending arm of said sear member, and is also engageable by said generally upwardly extending leg to limit rotation of the trigger member.

11. The simulated firearm of claim 7, in which said cocking means comprises:

(a) a rigid rod member fixed to said body and extending forward, parallel to and below the barrel;

(b) a slider cock means generally surrounding the barrel;

(c) a ram member rigidly connected to the slider cock means, said ram member including a portion extending rearward toward said upwardly extending arm of said sear member, and a tab portion extending downward toward said rigid rod member;

(d) a rocking biasing means connected between the forward portion of said rigid rod member and said tab portion to bias the ram member forward to a rest position, whereby when the upwardly extending arm of the sear member is in the release position, and said ram member is in said rest position, said ram member does not contact said upwardly extending arm, but when a user pulls said slide cock member rearwardly against said recocking biasing means, said ram member contacts said upwardly extending arm to pivot it rearwardly to said rear position.

12. The simulated firearm of claim 11, including a sheath which surrounds said rigid rod member and recocking biasing means, said sheath including a slot extending along the upper portion thereof through which said tab extends.

13. The simulated firearm of claim 11 in which said barrel is hollow, and said ram member includes a forward portion which slides within said hollow barrel.

* * * * *